US010343294B2

(12) United States Patent
Garavaglia et al.

(10) Patent No.: US 10,343,294 B2
(45) **Date of Patent: *Jul. 9, 2019**

(54) AMBIDEXTROUS UTILITY KNIFE

(71) Applicant: Pacific Handy Cutter, Inc., Irvine, CA (US)

(72) Inventors: Joseph P. Garavaglia, Newport Beach, CA (US); Brandon L. Spoelstra, Costa Mesa, CA (US); Markus Gropl, Huntington Beach, CA (US); Chris Lung, Santa Ana, CA (US); Mark Marinovich, Rancho Santa Fe, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 163 days.

This patent is subject to a terminal disclaimer.

(21) Appl. No.: 14/962,694

(22) Filed: Dec. 8, 2015

(65) Prior Publication Data

US 2016/0318195 A1 Nov. 3, 2016

Related U.S. Application Data

(60) Division of application No. 13/765,605, filed on Feb. 12, 2013, now Pat. No. 9,205,569, which is a continuation of application No. 13/285,484, filed on Oct. 31, 2011, now Pat. No. 9,205,568.

(51) Int. Cl.

| | |
|---|---|
| ***B26B 5/00*** | (2006.01) |
| ***B26B 29/02*** | (2006.01) |
| ***B26B 1/08*** | (2006.01) |
| ***B26B 1/10*** | (2006.01) |

(52) U.S. Cl.
CPC ..... *B26B 5/001* (2013.01); *B26B 1/10* (2013.01); *B26B 29/02* (2013.01)

(58) Field of Classification Search
CPC .. B26B 1/08; B26B 1/10; B26B 5/001; B26B 29/02
See application file for complete search history.

(56) References Cited

U.S. PATENT DOCUMENTS

| | | | | |
|---|---|---|---|---|
| 2,247,290 A * | 6/1941 | Disbrow | B26B 27/005 | 30/2 |
| 2,650,422 A * | 9/1953 | Soltow | B26B 5/00 | 30/154 |
| 3,518,758 A * | 7/1970 | Bennett | B26B 5/005 | 30/154 |
| 3,851,986 A * | 12/1974 | Daughtry | B26B 1/046 | 30/125 |

(Continued)

*Primary Examiner* — Hwei-Siu C Payer
(74) *Attorney, Agent, or Firm* — Peter L. Holmes

(57) ABSTRACT

A cutter apparatus includes a housing with a blade carrier configured for holding a blade, and a handle coupled to the housing via an engagement interface configured to allow a user of the cutter apparatus to selectively interfit together the housing and the handle in multiple different cutter apparatus configurations, wherein the engagement interface includes a coupler configured to permit the housing and the handle to be repositioned further apart in a housing/handle reconfiguring mode in which the coupler permits the handle to be rotatably repositioned in relation to the housing or vice versa while substantially limiting longitudinal movement of the housing relative to the handle.

20 Claims, 26 Drawing Sheets

(56) References Cited

U.S. PATENT DOCUMENTS 3,978,584 A * 9/1976 Mayer ..... B26B 13/20 30/256
4,226,020 A * 10/1980 Quenot ..... B26B 5/002 30/162
4,872,231 A * 10/1989 Gustavsen ..... A47G 27/0487 30/317
4,912,349 A * 3/1990 Chang ..... B25F 5/02 173/170
5,012,581 A * 5/1991 Fletcher ..... B26B 5/003 30/151
5,386,632 A * 2/1995 Schmidt ..... B26B 5/001 30/125
5,502,896 A * 4/1996 Chen ..... B26B 5/002 30/162
5,535,947 A * 7/1996 Hogue ..... E01B 21/04 238/2
5,613,300 A * 3/1997 Schmidt ..... B26B 5/001 30/125
5,659,959 A * 8/1997 Parlowski ..... B26B 13/20 16/430
D413,247 S * 8/1999 Schmidt ..... D8/99
6,008,586 A * 12/1999 Norman ..... H05B 41/295 315/94
D433,304 S * 11/2000 Schmidt ..... D8/99
D435,419 S * 12/2000 Schmidt ..... D8/98
6,314,646 B1 * 11/2001 Schmidt ..... B26B 5/001 30/125
D475,910 S * 6/2003 Schmidt ..... D8/98
6,637,112 B2 * 10/2003 Davis ..... B26B 27/005 30/162
6,675,485 B1 * 1/2004 Shih ..... B26B 1/10 30/321
6,973,726 B2 * 12/2005 Kramer ..... A01G 3/053 16/110.1
7,082,688 B2 * 8/2006 Votolato ..... B26B 5/001 30/2
D544,774 S * 6/2007 Schmidt ..... D8/99
7,287,331 B2 * 10/2007 Sasaki ..... A01G 3/053 16/110.1
7,475,480 B2 * 1/2009 Votolato ..... B26B 5/00 30/2
7,958,642 B2 * 6/2011 Rosskamp ..... A01G 3/053 30/228
7,987,602 B2 * 8/2011 Kanemoto ..... B26B 5/001 30/152
8,003,504 B2 * 8/2011 Immorlica ..... H01L 29/66462 257/E21.24
8,156,656 B2 * 4/2012 Tate ..... A01G 3/053 16/110.1
8,572,852 B1 * 11/2013 Jennings ..... B26B 5/001 30/162
8,739,414 B2 * 6/2014 Tyers ..... B25F 1/00 30/162
9,205,568 B2 * 12/2015 Garavaglia ..... B26B 29/02
9,205,569 B2 * 12/2015 Garavaglia ..... B26B 1/10
2005/0172416 A1 * 8/2005 Feliciano ..... B25F 1/04 7/148
2005/0188552 A1 * 9/2005 Gist ..... B23D 49/11 30/392
2005/0217114 A1 * 10/2005 Votolato ..... B26B 5/00 30/2
2007/0289148 A1 * 12/2007 Zhang ..... B23D 49/167 30/392
2008/0086895 A1 * 4/2008 Parks ..... B26B 5/001 30/156
2009/0090224 A1 * 4/2009 Lin ..... B25G 1/043 81/177.2
2009/0255129 A1 * 10/2009 Gringer ..... B26B 5/001 30/162
2009/0266210 A1 * 10/2009 Chung ..... B26B 5/00 83/144
2010/0037468 A1 * 2/2010 Rowlay ..... B26B 5/001 30/162
2010/0293796 A1 * 11/2010 Votolato ..... B26B 29/00 30/287
2012/0023753 A1 * 2/2012 Wen ..... B26B 1/046 30/156
2012/0304472 A1 * 12/2012 Medhurst ..... B26B 1/04 30/162
2013/0097876 A1 * 4/2013 Fong ..... A01G 3/053 30/277.4
2013/0104405 A1 * 5/2013 Garavaglia ..... B26B 5/001 30/295
2013/0305539 A1 * 11/2013 Garavaglia ..... B26B 1/10 30/122
2016/0288351 A1 * 10/2016 Garavaglia ..... B26B 5/001
2016/0318195 A1 * 11/2016 Garavaglia ..... B26B 1/10

* cited by examiner 1100
1104
1102
1210
1212
1218
1224
1214
1254a
1250
1252a
1233a
1236a
1232a
1235a
1234a
SAFE
TRAY CUT
TOP CUT
BLADE CHANGE 1250
1212
1210
1220
1224
1226
1252a
1216a
1214a
1232a
1230a
1233a 1214b
1220
1232b
1230b
1233b
1230
1224
1216b
1252b
1210
1212
1250

AMBIDEXTROUS UTILITY KNIFE

CROSS-REFERENCE TO RELATED APPLICATIONS

This application is a divisional of U.S. patent application Ser. No. 13/765,605, entitled "Ambidextrous Utility Knife" filed on Feb. 12, 2013 (now U.S. Pat. No. 9,205,569, issued on Dec. 8, 2015), which is a continuation-in-part of U.S. patent application Ser. No. 13/285,484, entitled "Ambidextrous Utility Knife", filed on Oct. 31, 2011 (now U.S. Pat. No. 9,205,568, issued on Dec. 8, 2015), all of which are hereby incorporated by reference.

This application is related to U.S. Design Patent Appl. No. 29/445,506, entitled "Knife Housing" filed on Feb. 12, 2013 (now U.S. Design Patent No. D708,499, issued on Jul. 8, 2014), which is hereby incorporated by reference.

TECHNICAL FIELD

The present invention relates generally to cutters and, in particular, an ergonomic hand tool such as a cutter and a reconfigurable housing and/or handle for same.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade locking, blade depth adjustment, blade change, or blade storage. Various ergonomic devices and apparatuses are also known.

It is known to provide a safety cutter with a guard (or guide) located a short distance from and facing a side of the cutting blade. See e.g., U.S. Pat. Nos. 5,386,632, 6,314,646 B1, U.S. Pat. No. D544,774 S, and U.S. Pat. No. 7,987,602 B2, which are hereby incorporated by reference.

Unfortunately, manufacturers or providers of such safety cutters, to accommodate a greater number of customers and operational considerations, must make available two different product versions, namely, a right-handed device in which the guard faces one side of the cutting blade and a left-handed device in which the guard faces the opposite side of the cutting blade. This, in turn, creates potential consumer confusion as to which version of the product might be best suited for a particular user or cutting operation. Moreover, twice as much shelf frontage is required to display two versions (rather than one version) of a product.

It would be useful to be able to provide one or more of: a guarded cutter (i.e., a cutter including or provided with a guard) that eliminates or lessens the need to provide both left- and right-handed versions of the cutter; a cutter with a mechanism or device that facilitates an improved, advantageous, or otherwise desirable or useful blade change operation for the cutter; and a cutter with a mechanism or device that facilitates improved, advantageous, or otherwise desirable or useful blade storage within the cutter.

SUMMARY OF THE INVENTION

In an example embodiment, a cutter apparatus includes a housing with a blade carrier configured for holding a blade in multiple different cutting edge orientations in relation to the housing, the cutting edge orientations including a pair of cutting edge orientations that are mirror images of each other, and a handle coupled to the housing via an engagement interface configured to allow a user of the cutter apparatus to selectively interfit together the housing and the handle in multiple different cutter apparatus configurations including a pair of configurations which, in conjunction with cutting edge orientations respectively selected from the pair of mirror image cutting edge orientations, accommodate ambidextrous operation of the cutter apparatus.

In an example embodiment, a cutter apparatus includes a housing, configured for holding a blade, and a handle coupled to the housing via an engagement interface configured to allow a user of the cutter apparatus to selectively interfit together the housing and the handle in multiple different cutter apparatus configurations including a pair of configurations accommodating left and right-handed operation of the cutter apparatus, respectively.

In an example embodiment, a cutter apparatus includes a housing configured for gripping by a hand, a blade holder and/or blade coupled to the housing, a guard secured to the housing, and a handle coupled to the housing via an engagement interface configured to allow a user of the cutter apparatus to selectively interfit together the housing and the handle in multiple different cutter apparatus configurations including a pair of configurations in which the guard, in relation to each configuration, faces the blade from right and left sides, respectively, of the cutter apparatus.

In an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other.

In an example embodiment, a cutter apparatus includes a distal portion including a housing with an opening, a blade carrier coupled to and repositionable in relation to the housing, and multiple cut guards, and a proximal portion coupled to the distal portion such that the portions are repositionable in relation to and interfit with each other in multiple different configurations in which the portions are secured together and a different cut guard is positioned for contact with a workpiece for each of the configurations.

In an example embodiment, a cutter apparatus includes a housing, a blade holder coupled to the housing, and multiple guards coupled to the housing, at least two of the guards being fixed in position in relation to each other.

In an example embodiment, a cutter apparatus includes a housing configured for gripping by a hand, a blade holder and/or a blade coupled to the housing, and a blade storage assembly that is coupled to the housing and rotatably repositionable about an axis parallel or substantially parallel to a longitudinal axis associated with the blade holder and/or the blade.

In an example embodiment, a cutter apparatus includes a housing configured for gripping by a hand, a blade holder and/or a blade coupled to the housing, and a blade storage assembly coupled to and repositionable in relation to a portion of the housing, the blade storage assembly including a blade storage compartment configured for holding spare blades and a plurality of springs configured to secure blades within the blade storage compartment and prevent the blade storage assembly from being completely removed from the housing.

In an example embodiment, a cutter apparatus includes a housing, a blade carrier coupled to the housing and repositionable in relation to the housing, and multiple safety actuators configured to disengage, when a plurality of the safety actuators are activated, one or more interlocks that prevent the blade carrier from being repositioned for a blade change operation.

In an example embodiment, a cutter apparatus includes a housing with a blade carrier configured for holding a blade, and a handle coupled to the housing via an engagement interface configured to allow a user of the cutter apparatus to selectively interfit together the housing and the handle in multiple different cutter apparatus configurations, wherein the engagement interface includes a coupler configured to permit the housing and the handle to be repositioned further apart in a housing/handle reconfiguring mode in which the coupler permits the handle to be rotatably repositioned in relation to the housing or vice versa while substantially limiting longitudinal movement of the housing relative to the handle.

In an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other to a housing/handle reconfiguring mode at which a circumferential engagement interface facilitates rotational mobility of the handle in relation to the housing, or vice versa, while resisting a longitudinal repositioning of the housing toward to the handle.

In an example embodiment, a cutter apparatus includes a housing with a blade carrier configured for holding a blade, and a handle coupled to the housing via an engagement interface configured to allow a user of the cutter apparatus to selectively interfit together the housing and the handle in multiple different cutter apparatus configurations, wherein the engagement interface includes a coupler configured to permit the housing and the handle to be repositioned further apart in a housing/handle reconfiguring mode in which the handle is rotatably repositionable in relation to the housing or vice versa and to engage a portion of the handle when the handle and housing are interfitted together in a locked configuration.

In an example embodiment, a cutter apparatus includes a housing configured for gripping by a hand, a blade holder and/or a blade coupled to the housing, and a blade storage assembly coupled to and repositionable in relation to a portion of the housing, the blade storage assembly including a blade storage compartment and engagement members, wherein the housing includes side wall portions, and the side wall portions and the engagement members are configured to secure the blade storage assembly in one or more positions in relation to the housing.

In an example embodiment, a cutter apparatus includes a handle, a blade holder and/or a blade coupled to the handle, and a blade storage assembly coupled to and repositionable in relation to a portion of the handle, wherein one or more of the handle and the blade storage assembly define recesses configured to be engaged by a user of the cutter apparatus for repositioning the blade storage assembly in relation to the housing.

In an example embodiment, a cutter apparatus includes a handle, a blade carrier coupled to the handle and repositionable in relation to the handle, and a slider button coupled to the blade carrier such that a blade held by the blade carrier is extendable from the handle when the button is deployed, the slider button including a series of ridges that extend across the slider button.

In an example embodiment, a cutter apparatus includes a housing, a blade holder coupled to the housing, the blade holder including chamfers configured for retaining a blade on the blade holder.

In an example embodiment, a cutter apparatus includes a housing configured for gripping by a hand, a blade holder and/or blade coupled to the housing, and one or more guards coupled to the housing, at least one of said guards having an opening and being configured such that the opening faces a workpiece when said guard is brought into contact with and repositioned over the workpiece.

DISCLOSURE OF INVENTION

Figure 1:
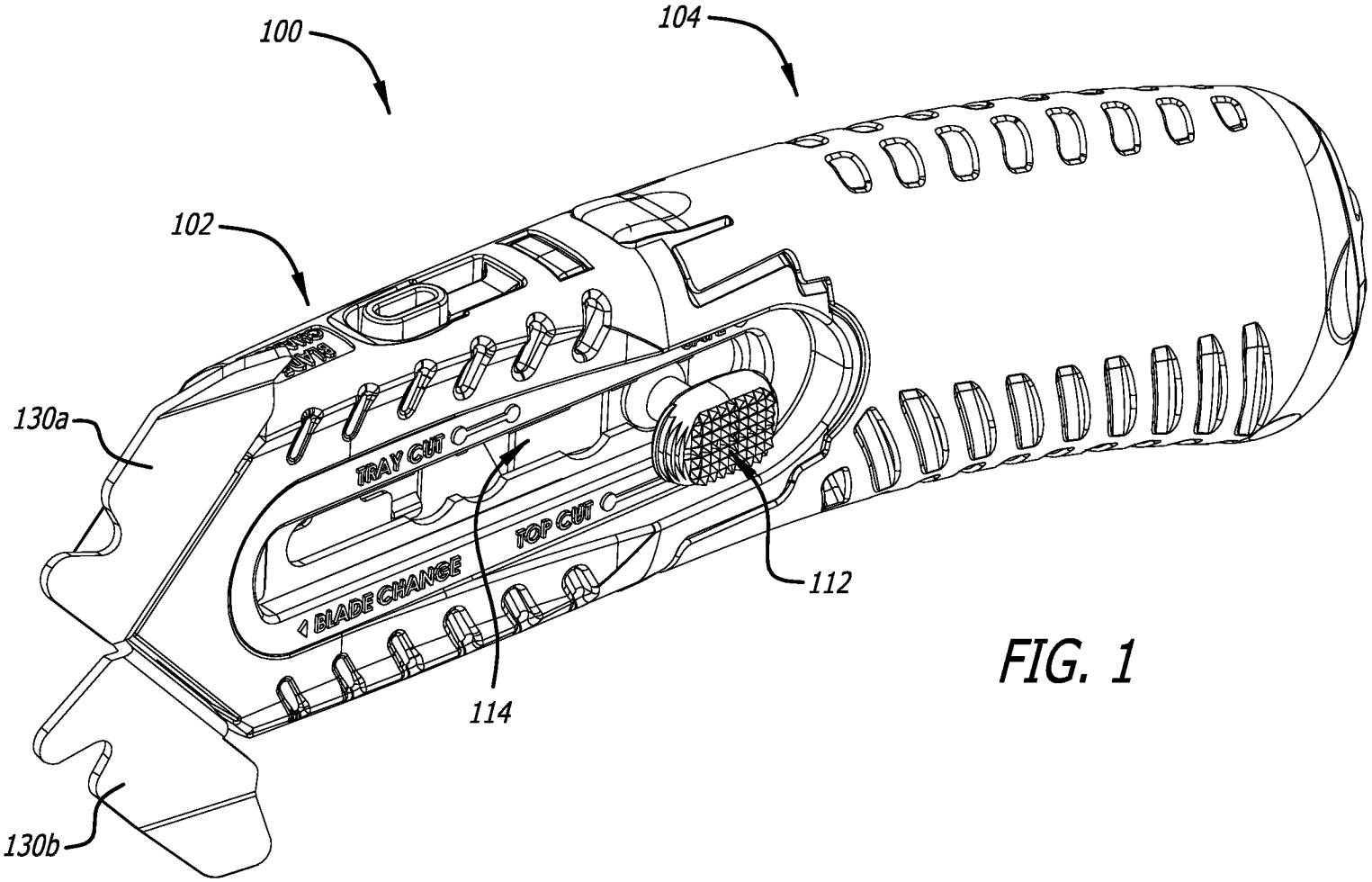
FIG. 1 is a perspective view of an example embodiment of a cutter apparatus.

Referring to FIGS. 1, 2A, 2B, 3, and 4, in this example embodiment, a cutter apparatus 100 includes a housing portion (or body front) 102 and a handle portion (or body rear) 104 configured to be coupled or interfitted in multiple different cutter apparatus configurations. The housing portion 102 and the handle portion 104 can be formed of various materials, for example, a thermoplastic that has high strength, rigidity, and impact resistance (e.g., Acrylonitrile butadiene styrene (ABS)), and by various processes (e.g., injection molding).

The handle portion 104 is coupled to the housing portion 102 via an engagement interface 106 (e.g., configured as shown). In this example embodiment, the engagement interface 106 is configured to allow a user of the cutter apparatus 100 to selectively interfit together the housing portion 102 and the handle portion 104 in multiple different cutter apparatus configurations.

The cutter apparatus 100 includes a channel/guard structure 108 secured to the housing portion 102 (e.g., fixedly secured by complementary surfaces or portions of the housing) and a blade carrier (or blade holder) 110 with a blade activation button 112. In this example embodiment, the channel/guard structure 108 includes or defines a channel 109 configured to support the blade carrier 110 such that the blade carrier 110 is repositionable along the channel 109. The channel/guard structure 108 can be formed of various materials, for example, a material made of or including a metal (or a metal alloy or a plastic) that has high strength and wear resistance (e.g., steel), and by various processes (e.g., progressive die stamping). The blade carrier 110 can be formed of various materials, for example, a material made of or including a metal (or a metal alloy or a plastic) that has high strength and wear resistance (e.g., stainless steel), and by various processes (e.g., progressive die stamping). The blade activation button 112 can be formed of various materials, for example, a zinc alloy (e.g., Zamak 2), and by various processes (e.g., die cast).

Figure 4:
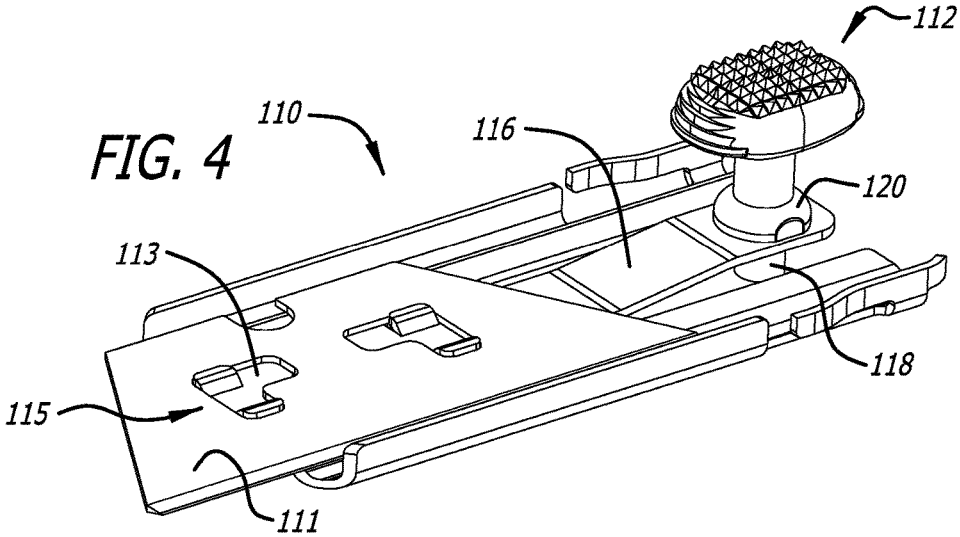
FIG. 4 is a perspective view of the blade carrier and the blade activation button of FIG. 3 shown assembled and with a blade positioned on the blade carrier.
Figure 4A:
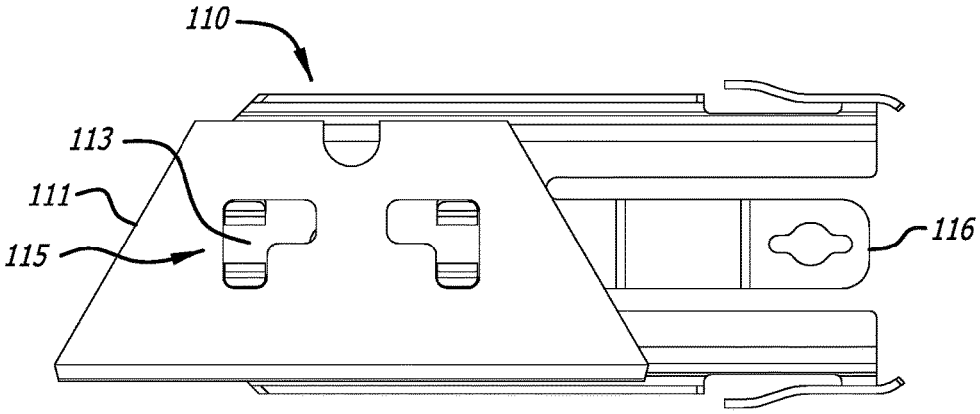
FIGS. 4A and 4B show a pair of cutting edge orientations that are mirror images of each other.
Figure 4B:
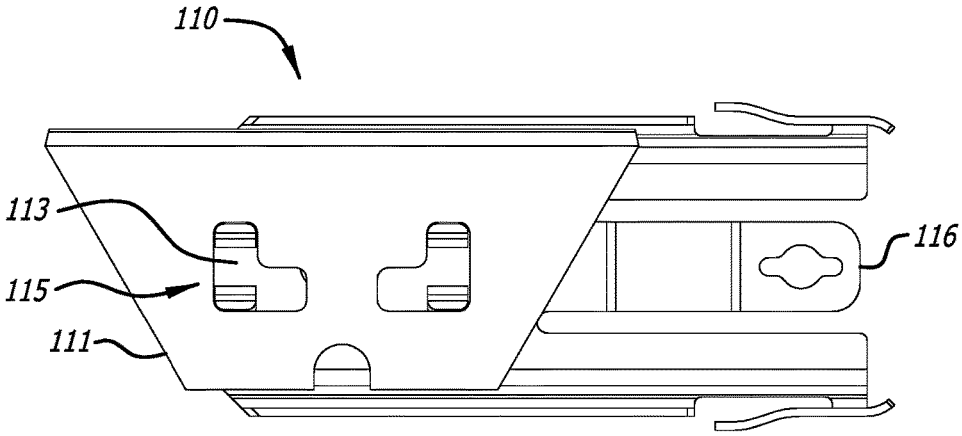

Referring additionally to FIGS. 4A and 4B, in this example embodiment, the blade carrier 110 is configured to hold a blade 111 in multiple different cutting edge orientations (e.g., with the blade 111 secured between the blade carrier 110 and one or more portions of the channel/guard structure 108). In this example embodiment, the blade carrier 110 and a blade 111 are configured such that the multiple different cutting edge orientations include a pair of mirror image cutting edge orientations.

In example embodiments, the blade carrier 110 and the blade 111 are configured with symmetrical complementary engagement portions. By way of example, a substantially flat surface (or portion) 113 of the blade carrier 110 includes or is provided with protrusions 115 (e.g., fixed tabs or other raised structures shaped and positioned as shown) configured to accommodate positioning the blade 111 adjacent to the substantially flat surface 113 with the protrusions 115 extending through one or more apertures in the blade and/or engaging complementary surfaces of the blade preventing the blade from repositioning along the blade carrier 110.

Figure 5:
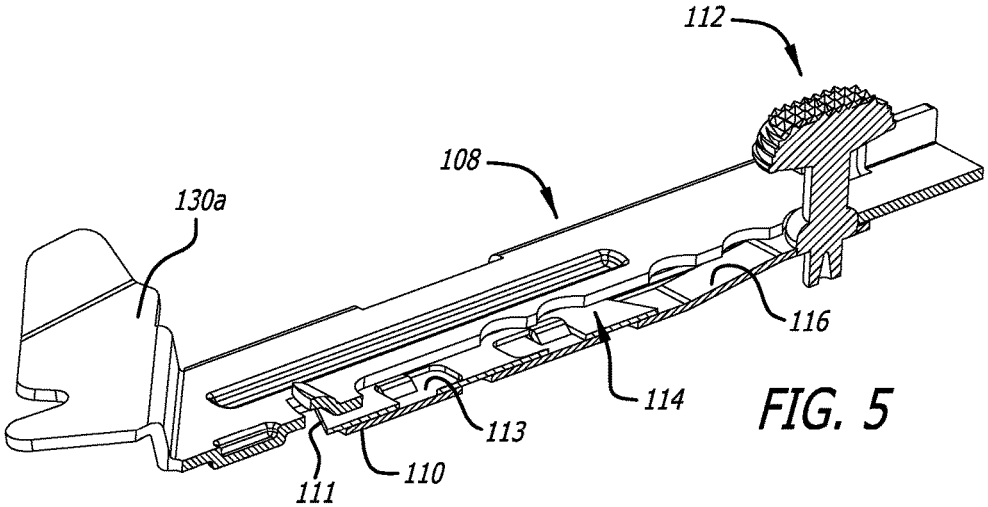
FIG. 5 is a cross-sectional perspective view of the channel/guard structure of FIG. 3 shown with the blade activation button (of the blade carrier) at a safe position along a guide channel (of the channel/guard structure)
Figure 6:
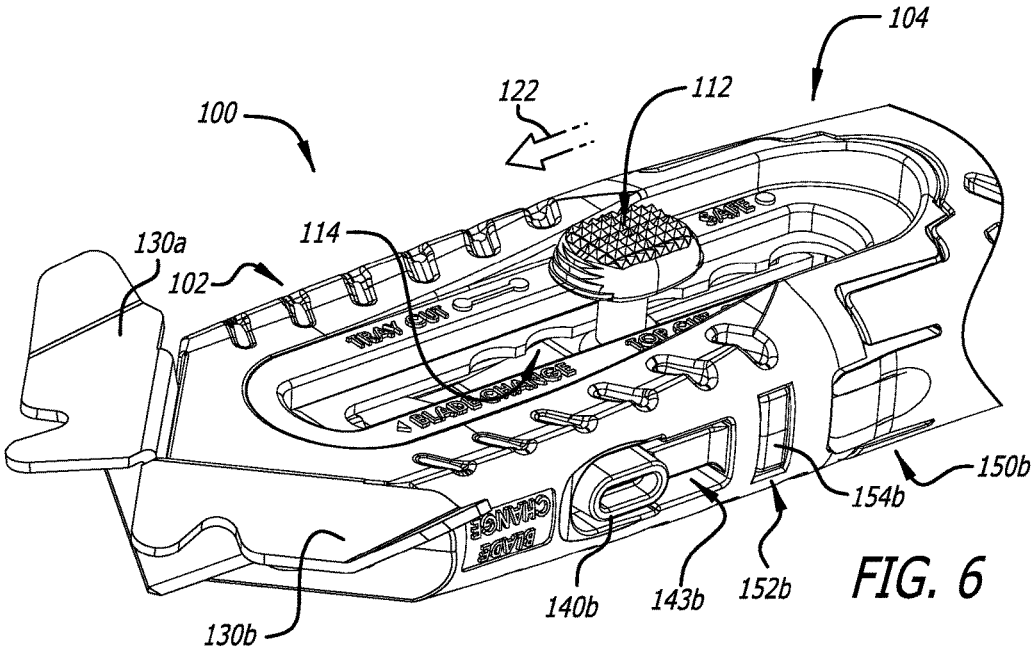
FIG. 6 is a partial perspective view of the cutter apparatus of FIG. 1, the blade activation button is shown repositioning along the guide channel from a top cut position to a tray cut position.

In example embodiments, the blade carrier 110 is coupled to and repositionable in relation to (e.g., along a channel defined by) the channel/guard structure 108 and/or one or more other portions or components of the cutter apparatus 100. In this example embodiment, the channel/guard structure 108 includes or is provided with a guide channel 114 (e.g., as shown) and the blade carrier 110 includes or is provided with a spring member 116 or other biasing component or element (e.g., a resilient portion of the blade carrier 110 extending proximally from the substantially flat surface 113). A connector element 118 (e.g., a post) traverses the guide channel 114 connecting (or otherwise securing or coupling together) the blade activation button 112 and the spring member 116 at opposite sides of the guide channel 114. A bearing portion 120 of the connector element 118, biased by the spring member 116, detents outwardly to engage with the various blade carrier position setting portions (i.e., the wider portions) of the guide channel 114. In this example embodiment, and referring additionally to FIGS. 5 and 6, the blade carrier position setting portions, starting at the proximal end of the guide channel 114 and moving toward its distal end, facilitate securing the blade carrier 110 in a "safe" position (in which the blade 111 is fully retracted within the housing portion 102), first and second "top cut" blade extension positions, and first and second "tray cut" blade extension positions, respectively. In FIG. 6, the blade activation button 112 is shown repositioning (as denoted by arrow 122) along the guide channel 114 from the second "top cut" position to the first "tray cut" position.

The blade 111 is activated by depressing the blade activation button 112 and sliding the index forward to reposition the blade carrier 110 forward (or distally) along the channel 109 (of the channel/guard structure 108). The spring member 116 (e.g., a flexible arm on the blade carrier 110) pushes the blade activation button 112 up into cutouts in the guide channel 114. In this example embodiment, there are six depth settings in total: safe, two top cut positions, two tray cut positions, and also (as discussed below) a blade change position.

Example embodiments of cutters (or cutter apparatuses) include multiple guards at least two of which are fixed in position in relation to each other. In example embodiments, the multiple guards include two guards positioned at opposite sides of the cutter (or cutter housing). One or more of the multiple guards can be provided on, secured to, or integrally formed as part of the channel/guard structure 108.

In example embodiments, the multiple guards include at least two guards that are fixed in position in relation to a distal portion of the cutter. For example, one or more of the guards can be secured to the distal portion in a manner that prevents or discourages or at least does not readily facilitate removal or separation of the guard(s) from the distal portion by a user of the cutter. The multiple guards can additionally, or alternatively, include one or more guards that are detachable.

In example embodiments, a cutter (or cutter apparatus) includes guards that are mirror images of each other (e.g., symmetrical in relation to each other and also in relation to a distal portion of the cutter). In this example embodiment, the channel/guard structure 108 includes or is provided with two guards 130*a* and 130*b* that are mirror images of each other. The guards can be coupled together by a common component or element of the cutter. The guards 130*a* and 130*b* can be, for example, integrally formed with an actuator guide portion 132 (of channel/guard structure 108) that includes and/or defines the guide channel 114. In example embodiments, the multiple guards are one or more of directly coupled (e.g., in direct contact with each other), indirectly coupled (e.g., coupled together by one or more intermediary coupling elements or components), continuously coupled (e.g., at all times and/or by a continuous coupling structure or mechanism), and intermittently coupled (e.g., when one or more of the guards is detachable).

Thus, in an example embodiment, a cutter apparatus includes a housing, a blade holder coupled to the housing, and multiple guards coupled to the housing, at least two of the guards being fixed in position in relation to each other and/or in relation to a distal portion of the housing. In example embodiments, the blade holder includes a blade carrier coupled to and repositionable in relation to the housing. Although example embodiments of cutters (or cutter apparatuses) described herein include a blade carrier (or blade holder) that is configured to be repositionable (e.g., in relation to the cutter housing), the scope of the present invention(s) additionally includes and/or contemplates cutters (or cutter apparatuses) with a blade holder that is coupled to the housing, but not repositionable (e.g., a fixed blade).

Example embodiments of cutters (or cutter apparatuses) include a blade carrier (or other component or element of the cutter) that is repositionable in relation to a portion of the cutter and multiple safety actuators configured to facilitate an action or process of disengaging one or more interlocks that prevent the blade carrier (or other component or element of the cutter) from being repositioned (e.g., for a blade change operation). The multiple (e.g., two or more independently repositionable) safety actuators can be configured to disengage the one or more interlocks, for example, when a plurality of the safety actuators are activated (e.g., two or more, or all of the safety actuator, are simultaneously in an activated state).

Figure 7:
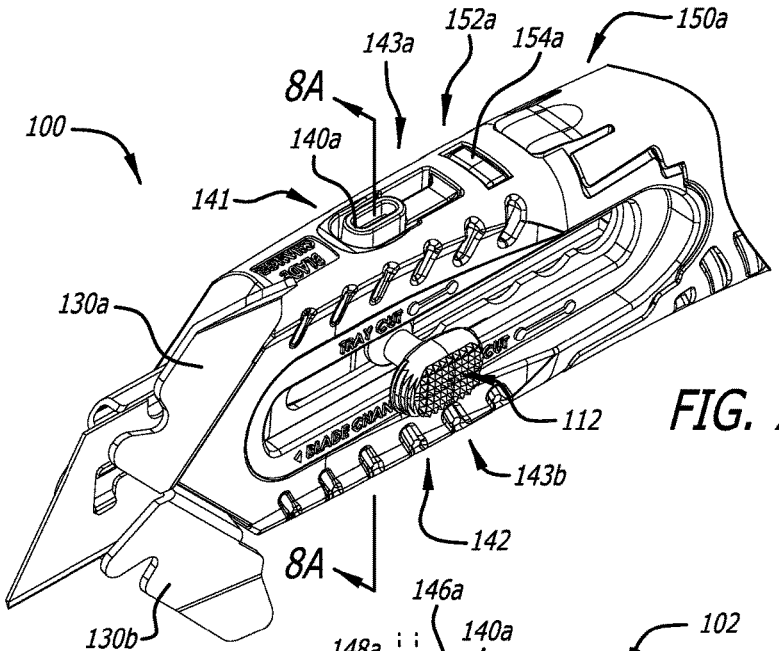
FIG. 7 is a partial perspective view of the cutter apparatus of FIG. 1 in which the blade carrier and its blade activation button are positioned along the guide channel at a distalmost tray cut position.
Figure 8A:
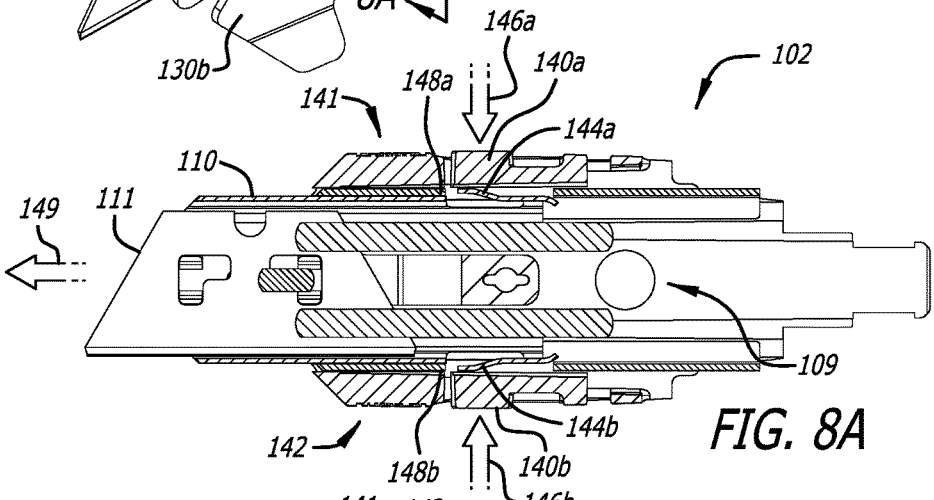
FIG. 8A is a cross-sectional view of the cutter apparatus along lines 8A-8A of FIG. 7 showing dual safety actuators that are repositionable for disengaging interlocks that prevent the blade carrier from being repositioned (extended) to a blade change position.

The safety actuators can include, by way of example, dual actuators configured to function as a Boolean AND operator, i.e., requiring both actuators to be activated in order to release the blade carrier or other component or element of the cutter. Referring to FIGS. 6, 7, and 8A, in this example embodiment, the cutter apparatus 100 includes safety actuators 140*a* and 140*b* located at the top side 141 and the bottom side 142, respectively, of the housing portion 102. The safety actuators 140*a* and 140*b* are located within recesses 143*a* and 143*b*, respectively, in the housing portion 102 (e.g., substantially flush with adjacent exterior surfaces of the housing when not activated). The safety actuators 140*a* and 140*b* can include or be provided in the form of flexible components (e.g., levers coupled or secured to or integrally formed with the housing portion 102) configured to be repositionable in relation to the one or more interlocks. The safety actuators 140*a* and 140*b* can include or be provided in the form of inflexible, rigid, or partially flexible or resilient components as well as articulated components and associated interconnection mechanisms and devices.

Figure 8B:
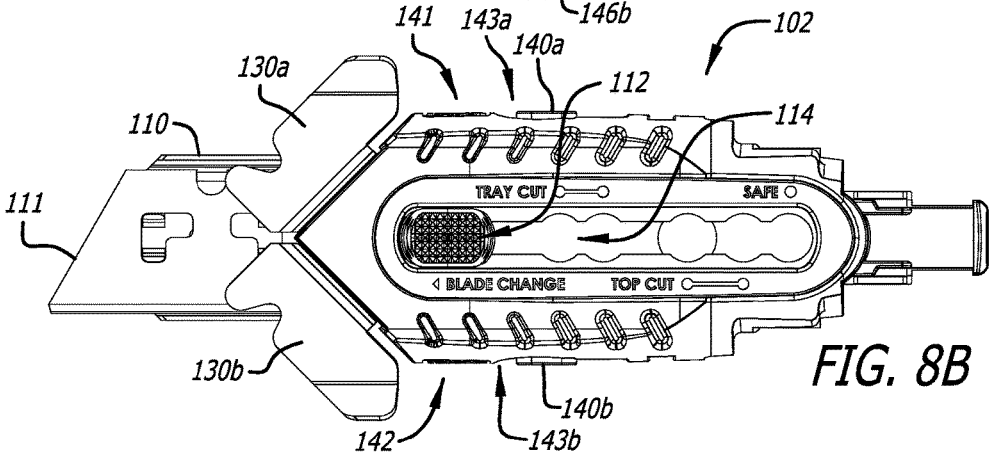
FIG. 8B is a side view of the housing portion of the cutter apparatus of FIG. 1 showing the blade carrier extended from the housing portion to the blade change position.

In example embodiments, the safety actuators are biased to reposition away from the one or more interlocks (the biasing forces being imparted, for example, by the actuators themselves and/or by one or more other components or elements of the cutter). In example embodiments, the one or more interlocks include portions configured to reposition (to respective blade carrier release positions) in response to activation of the safety actuators. Referring to FIGS. 4, 4A, 4B, and 8A, in this example embodiment, the blade carrier 110 includes engagement elements 144*a* and 144*b* (e.g., springs coupled or secured to or integrally formed with the blade carrier 110) configured to be repositionable (e.g., in relation to surfaces or portions of the channel 109) in response to activation of the safety actuators as denoted by arrows 146*a* and 146*b*, respectively. The engagement elements 144*a* and 144*b* reposition inwardly (e.g., flexing laterally in relation to the housing portion 102), disengaging from cutouts 148*a* and 148*b* (of the channel 109), respectively. When both of the safety actuators 140*a* and 140*b* are activated (depressed), the blade carrier 110 is free to be repositioned (extended distally) as denoted by arrow 149 to its blade change position (e.g., a distal-most or fully extended position, as illustrated in FIG. 8B, at which the blade activation button 112 is prevented from further forward movement due to its connector element 118 contacting the distal end of the guide channel 114). If either of the safety actuators 140*a* and 140*b* is not activated (depressed), its corresponding engagement element interlocks with a cutout in the channel thereby preventing the user from accidentally putting the cutter in the blade change position. After the cutter is in the blade change position, the blade 111 can be easily removed and replaced.

The multiple safety actuators can include dual blade change levers and/or other repositionable components or elements. In example embodiments, the multiple safety actuators include dual actuators that are symmetrical (e.g., in relation to each other and also in relation to a distal portion of the cutter), positioned at opposite sides of the cutter housing, and/or are configured to activate when repositioned toward each other. The safety actuators can be, but are not necessarily, included or provided as part of the housing.

Thus, in an example embodiment, a cutter apparatus includes a housing, a blade carrier coupled to the housing and repositionable in relation to the housing, and multiple safety actuators configured to disengage, when a plurality of the safety actuators are activated, one or more interlocks that prevent the blade carrier from being repositioned for a blade change operation.

Figure 3:
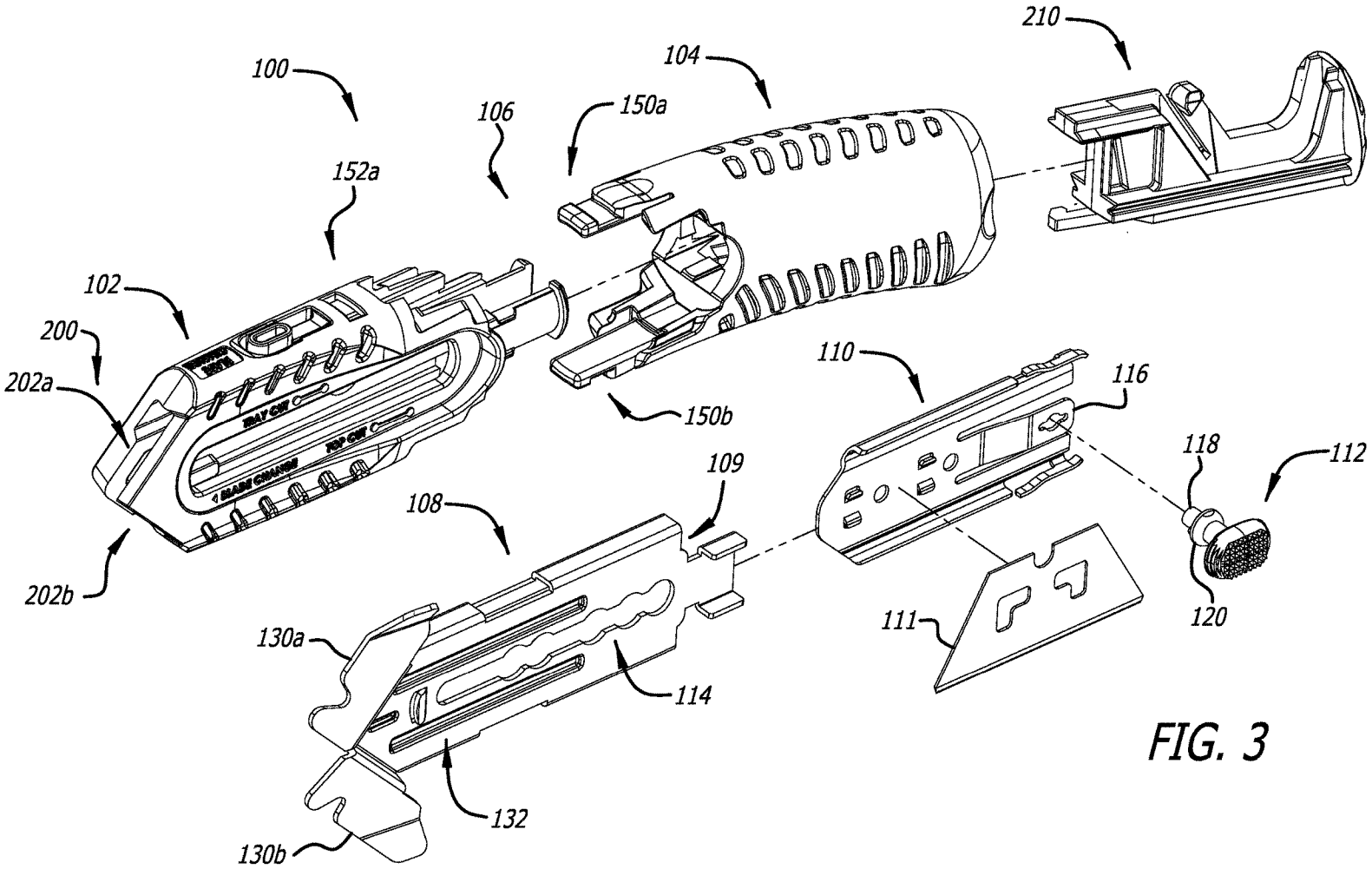
FIG. 3 is an exploded perspective view of the cutter apparatus of FIG. 1.

Example embodiments of cutters (or cutter apparatuses) include a mechanism or device that facilitates ambidextrous (left- and right-handed) operation of the cutter. The mechanism or device can include one or more engagement interfaces, for example, an exterior interface and an interior interface. Referring to FIGS. 3, 6, and 7, in this example embodiment, the handle portion 104 includes symmetrical dual latches 150*a* and 150*b* (e.g., flexible members provided at opposite sides of the distal end of the handle portion 104) and the housing portion 102 includes symmetrical openings 152*a* and 152*b* (e.g., provided as shown at opposite sides of the housing portion 102). In this example embodiment, the openings 152*a* and 152*b* are formed or otherwise provided at the top side 141 and the bottom side 142, respectively. The latches 150*a* and 150*b* are received within the openings 152*a* and 152*b*, respectively, to secure the housing portion 102 and the handle portion 104 together when they are interfitted in either a left-handed configuration or a right-handed configuration. The latches 150*a* and 150*b* respectively include tabs 154*a* or 154*b* (or other protruding portions or structures) that are configured to engage side portions of the openings when the housing and the handle are secured together. In this example embodiment, the tabs 154*a* and 154*b* must both be depressed (pressed inward) in order to unlock the housing and handle portions.

Figure 9:
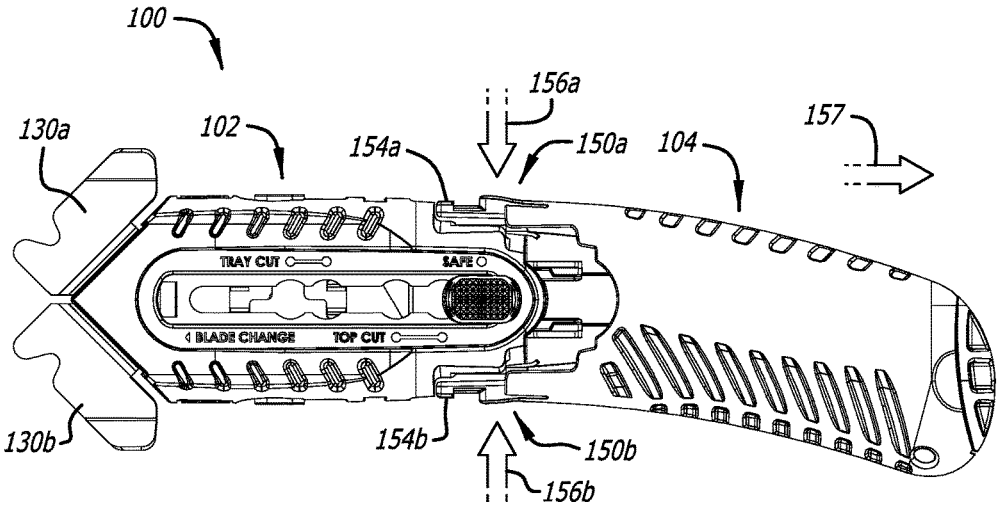
FIG. 9 is a side view of the cutter apparatus of FIG. 1 showing the handle portion disengaged from the housing portion, at an exterior interface defined therebetween, and repositioned sufficiently apart from the housing portion, at an interior interface defined therebetween, such that the handle and housing portions are rotatably repositionable in relation to each other for reconfiguring the cutter apparatus.

Example embodiments of cutters (or cutter apparatuses) include a housing portion (e.g., a distal portion) and a handle portion (e.g., a proximal portion) that are symmetrical about a first plane and a second plane, respectively. In example embodiments, the first and second planes are orthogonal. Referring to FIG. 9, in this example embodiment, a front body portion (e.g., front half) of the cutter apparatus 100 is symmetrical about (in relation to) an XZ plane (e.g., passing through the housing portion 102 and intersecting a point between the guards 130*a* and 130*b*) and a rear body portion (e.g., rear half) of the cutter apparatus 100 is symmetrical about (in relation to) an XY plane (e.g., passing through the handle portion 104 and intersecting a center point between left and right sides thereof). In conjunction with the blade carrier 110, which allows the blade 111 to be selectively positioned in one of a pair of cutting edge orientations that are mirror images of each other, use the cutter apparatus 100 during a cutting operation utilizing left- and right-handed cutter apparatus configurations as described herein will be identical for left- and right-handed users, respectively.

Thus, in an example embodiment, a cutter apparatus includes a housing, configured for holding a blade, and a handle coupled to the housing via an engagement interface configured to allow a user of the cutter apparatus to selectively interfit together the housing and the handle in multiple different cutter apparatus configurations including a pair of configurations accommodating left and right-handed operation of the cutter apparatus, respectively.

Example embodiments of cutters (or cutter apparatuses) include an engagement interface configured to facilitate selectively interfitting together portions of the cutter in multiple different ergonomic configurations (e.g., in relation to gripping the cutter by hand). The engagement interface can include or be defined, for example, by complementary surfaces (or other portions) of the housing and the handle, respectively. In example embodiments, the engagement interface is configured to permit the handle (e.g., upon release) to be rotatably repositioned in relation to the housing, or vice versa. In example embodiments, the engagement interface includes an exterior (e.g., peripheral) interface configured to automatically lock (or secure) the housing and the handle together when the housing and the handle are repositioned to interfit together in one (any) of the cutter apparatus configurations. In example embodiments, the exterior interface is configured to allow a user of the cutter apparatus to unlock (or disengage) the housing and the handle by actuating multiple release devices provided on one or more of the housing and the handle.

Figure 10:
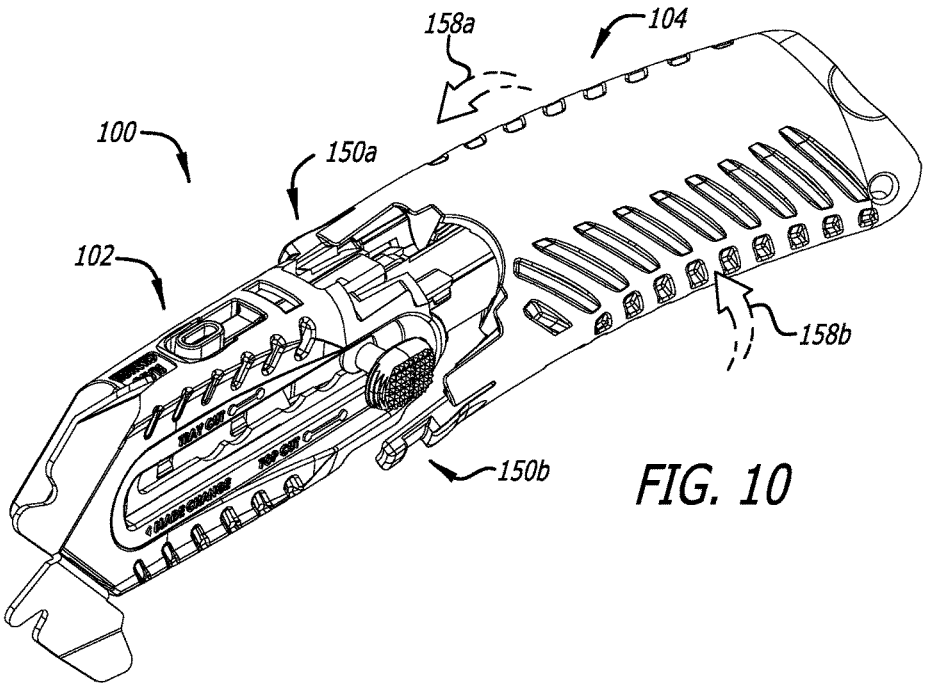
FIG. 10 is a perspective view of the cutter apparatus of FIG. 1 showing the handle portion being rotatably repositioned in relation to the housing portion.
Figure 11:
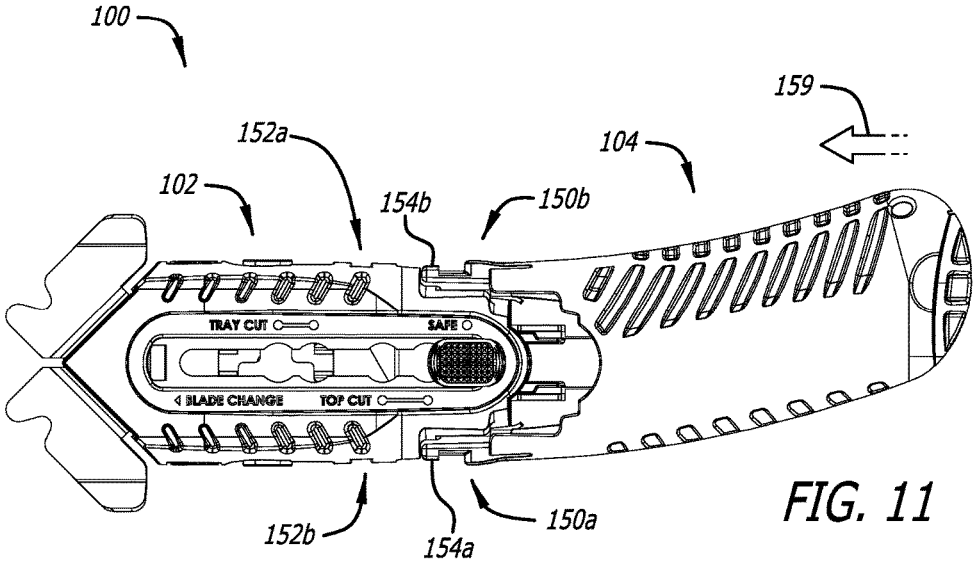
FIG. 11 is a side view of the cutter apparatus of FIG. 1 showing the handle portion repositioned in relation to and aligned for reengagement with the housing portion in a different cutter apparatus configuration.
Figure 12:
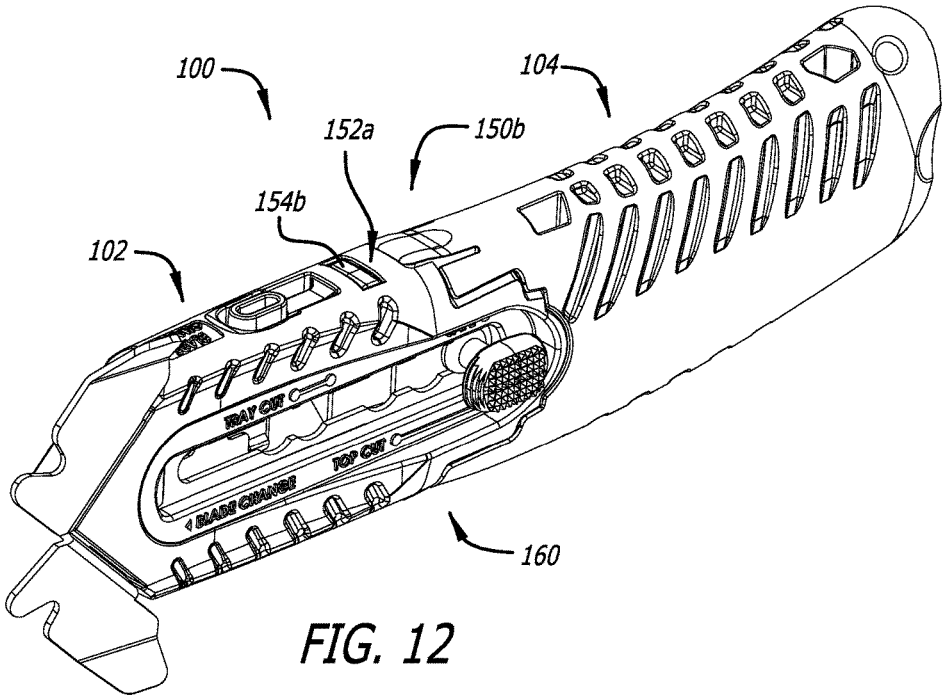
FIG. 12 is a perspective view of the cutter apparatus of FIG. 1 in which the handle portion has been repositioned in relation to and reengaged with the housing portion providing symmetrical cutter apparatus configuration.

Referring to FIG. 9, in this example embodiment, the cutter apparatus 100 is reconfigurable for use by left- or right-handed users by depressing the tabs 154*a* and 154*b* (of the handle portion 104) as denoted by arrows 156*a* and 156*b*, respectively, and sliding the handle portion 104 back as denoted by arrow 157. Referring to FIG. 10, with the handle portion 104 disengaged from the housing portion 102 and repositioned sufficiently apart from the housing portion 102, the handle and housing portions can now be rotatably repositioned in relation to each other, e.g., as shown by arrows 158*a* and 158*b*, for reconfiguring the cutter apparatus. Referring to FIG. 11, once the handle portion 104 is repositioned in relation to and aligned for reengagement with the housing portion 102 in a different cutter apparatus configuration, the handle portion 104 can be slid forward again as indicated by arrow 159. Referring to FIG. 12, the handle portion 104 is shown repositioned in relation to and reengaged with the housing portion 102 providing a cutter apparatus configuration that is symmetrical to the configuration shown in FIG. 1. An exterior interface 160 is provided (or defined), for example, by the symmetrical dual latches 150*a* and 150*b* (of the handle portion 104) and the symmetrical openings 152*a* and 152*b* (of the housing portion 102).

Thus, in an example embodiment, a cutter apparatus includes a housing with a blade carrier configured for holding a blade in multiple different cutting edge (or blade) orientations in relation to the housing, the cutting edge orientations including a pair of cutting edge orientations that are mirror images of each other, and a handle coupled to the housing via an engagement interface configured to allow a user of the cutter apparatus to selectively interfit (or connect) together the housing and the handle in multiple different cutter apparatus configurations including a pair of configurations (e.g., predetermined configurations) which, in conjunction with cutting edge orientations respectively selected from the pair of mirror image cutting edge orientations, accommodate ambidextrous operation of the cutter apparatus.

The engagement interface can be configured to allow the housing and the handle to interfit in multiple different predetermined configurations (e.g., two or more predetermined configurations) and/or only in predetermined configurations (e.g., configurations defined or rendered permissible by components or structures of the engagement interface). The engagement interface can be configured to allow the housing and the handle to interfit in multiple different symmetrical configurations (e.g., two or more symmetrical configurations) and/or only in symmetrical configurations (e.g., configurations that are symmetrical in relation to each other, symmetrical in their spacing, and/or symmetrical in relation to a point or location on the cutter.

Example embodiments of cutters (or cutter apparatuses) include an engagement interface with an inner (or central) portion and an outer (or peripheral) portion. In example embodiments, the engagement interface includes an interior interface (e.g., a central interface within the cutter apparatus) configured to couple (e.g., slidably and rotatably couple) the housing and the handle together. In example embodiments, a cutter apparatus includes a housing portion, a handle portion, and an interior interface defined therebetween such that the handle and housing portions are rotatably repositionable in relation to each other for reconfiguring the cutter apparatus. In example embodiments, the engagement interface includes a coupler configured to permit the handle to be rotatably repositioned in relation to the housing. The coupler includes, for example, a channel and a bearing (e.g., included as part of or provided on the handle and the housing, respectively, or vice versa). The bearing is secured or fitted (e.g., snapped-fitted) within and repositionable in relation to (e.g., along) the channel.

Referring to FIGS. 13, 13A, 14, 14A, and 14B, in this example embodiment, the housing and handle portions 102 and 104 include a bearing 162 and a channel 164, respectively. The bearing 162 is installed (e.g., snap-fitted) into the channel 164 and includes one or more engagement surfaces (or portions) configured to be repositionable in relation to the channel 164 (e.g., along and pivotally within the channel). In this example embodiment, the bearing 162 is slidably coupled with the channel 164. An interior interface 170 is provided (or defined), for example, by the bearing 162 (of the housing portion 102) and the channel 164 (of the handle portion 104).

Figure 13:
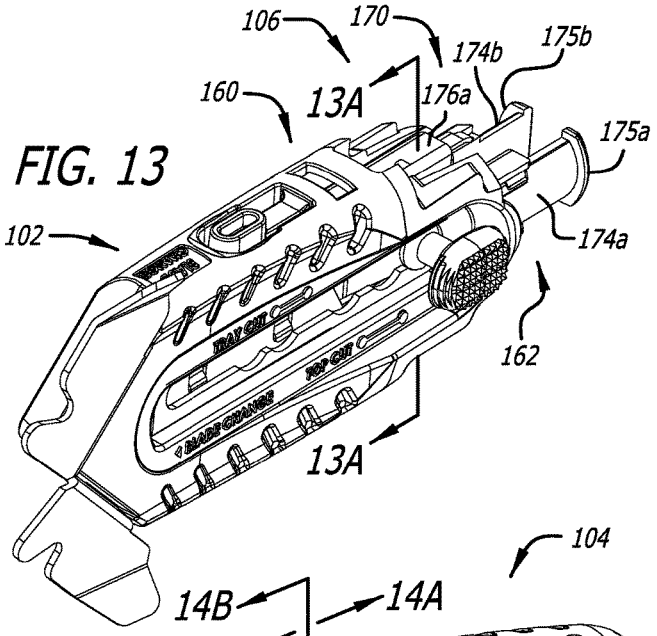
FIG. 13 is a perspective view of the housing portion of the cutter apparatus of FIG. 1.
Figure 13A:
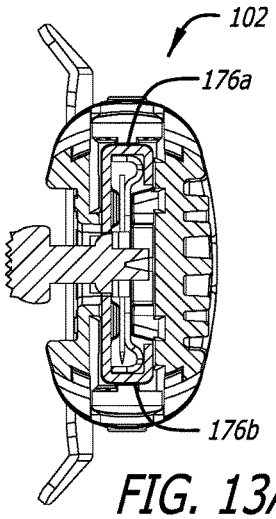
FIG. 13A is a cross-sectional view of the housing portion along lines 13A-13A of FIG. 13.
Figure 14:
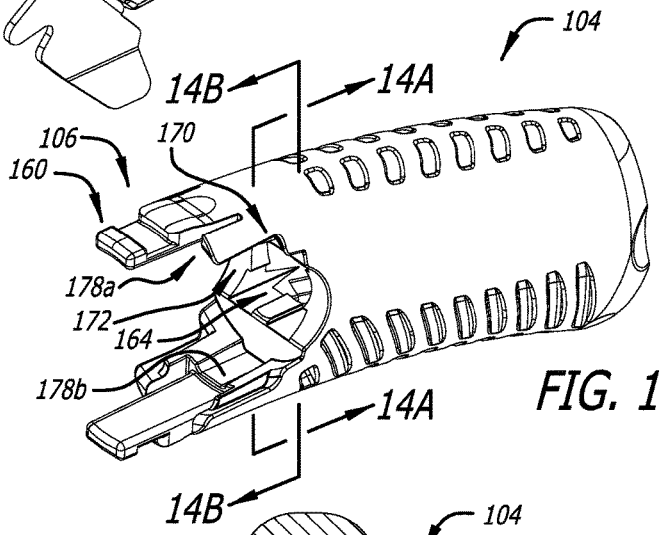
FIG. 14 is a perspective view of the handle portion of the cutter apparatus of FIG. 1.
Figure 14A:
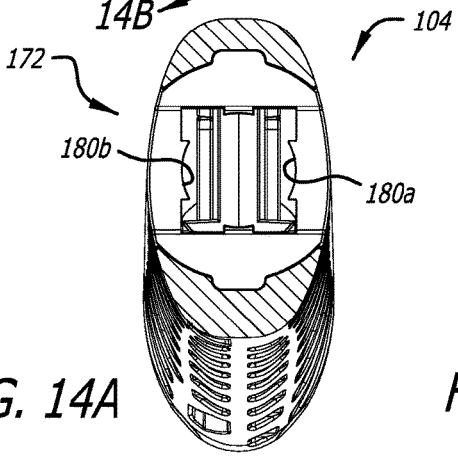
FIG. 14A is a cross-sectional view of the housing portion along lines 14A-14A of FIG. 14.
Figure 14B:
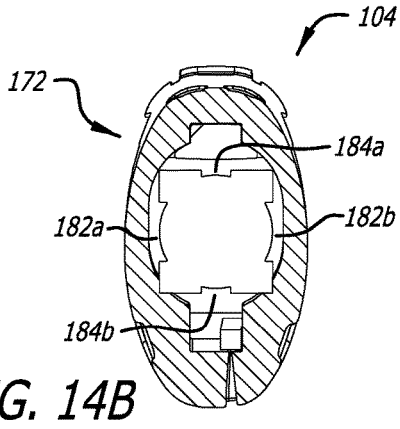
FIG. 14B is a cross-sectional view of the housing portion along lines 14B-14B of FIG. 14.

Example embodiments of cutters (or cutter apparatuses) include a mechanism or device that facilitates multiple different engagement configurations at which housing and handle portions of the cutter are secured together and, when the portions are not in one of the engagement configurations, maintains a coupling arrangement as between the housing and handle portions. To this end, the channel 164 (e.g., a cylindrical channel or bore) includes or is provided with an inwardly extending annular ridge or ridge structure 172, and the bearing 162 includes or is provided with dual symmetrical flexible members 174*a* and 174*b* with laterally extending end portions 175*a* and 175*b*, respectively, that are fitted into and secured within the channel 164. Referring to FIGS. 13A and 14, the housing portion 102 includes symmetrical raised portions 176*a* and 176*b*, and the handle portion 104 includes complementary recessed portions 178*a* and 178*b*. Referring to FIG. 14A, the ridge structure 172 includes or is provided with ridge portions 180*a* and 180*b* (e.g., as shown). The bearing 162 is installed in the channel 164 by pressing its flexible members 174*a* and 174*b* inward a sufficient amount to allow their respective laterally extending end portions 175*a* and 175*b* to reposition past the ridge portions 180*a* and 180*b* (of the ridge structure 172) and into the channel 164. With the symmetrical raised portions 176*a* and 176*b* aligned with the recessed portions 178*a* and 178*b*, respectively, or aligned with the recessed portions 178*b* and 178*a*, respectively, the handle portion 104 can be slid forward to engage with the housing portion 102 in the selected cutter apparatus configuration. The ridge structure 172 and the bearing 162 are configured such that the ridge structure 172 prevents the laterally extending end portions 175*a* and 175*b* (of the bearing 162) from exiting the channel 164 once the bearing 162 is snap-fitted into or otherwise installed in the channel 164. Referring to FIG. 14B, the ridge structure 172 includes or is provided with ridge portions 182*a*, 182*b*, 184*a*, and 184*b* (e.g., spaced as shown) that engage with the laterally extending end portions 175*a* and 175*b* when the bearing 162 is installed (and its flexible members 174*a* and 174*b* no longer compressed) preventing the laterally extending end portions 175*a* and 175*b* from being withdrawn from the channel 164. With the complementary portions of the exterior interface 160 disengaged, the housing portion 102 and the handle portion 104 remain coupled together and are repositionable (in this example, both longitudinally and rotationally) in relation to each other.

Thus, in an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other. In example embodiments, the housing and the handle are repositionable further apart from each other (e.g., when portions of an engagement interface therebetween are disengaged) and a portion of the housing (e.g., a bearing or other coupling component or structure) is slidably coupled with a recessed or other complementary portion of the handle. In example embodiments, the housing and the handle are configured to permit rotation of the handle (about an axis) in relation to the housing, or vice versa, when the housing and the handle are not secured together. In example embodiments, the housing and the handle are one or more of directly coupled (e.g., in direct contact with each other), indirectly coupled (e.g., coupled together by one or more intermediary coupling elements or components), continuously coupled (e.g., at all times and/or by a continuous coupling structure or mechanism), and intermittently coupled (e.g., when elements or components providing or defining an engagement interface are repositionable in relation to each other).

Figure 19:
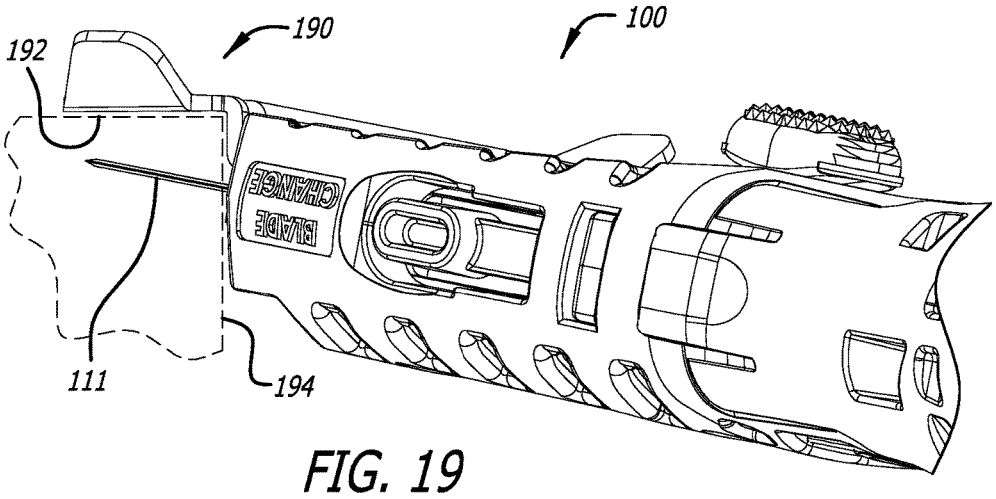
FIG. 19 is a partial perspective view of the cutter apparatus of FIG. 1 showing a blade extended from the cutter apparatus and a contact portion of a guard brought into contact with a workpiece during a cutting operation.

Example embodiments of cutters (or cutter apparatuses) include a guard (or guard structure) with multiple workpiece contact portions that are associated (e.g., mutually exclusively) with multiple different cutter configurations, respectively. Referring to FIG. 19, in this cutter apparatus configuration, the blade 111 is extended from the cutter apparatus 100, and a contact portion 192 of a guard 190 brought into contact with a workpiece 194 during a cutting operation. The guard 190 includes multiple contact portions, for example, symmetrical contact portions such as those provided by guards 130*a* and 130*b*.

Thus, in an example embodiment, a cutter apparatus includes a housing configured for gripping by a hand, a blade holder and/or blade coupled to the housing, a guard (or guide) secured (e.g., fixedly secured) to the housing, and a handle coupled to the housing via an engagement interface configured to allow a user of the cutter apparatus to selectively interfit together the housing and the handle in multiple different cutter apparatus configurations including a pair of configurations in which the guard, in relation to each configuration, faces the blade from right and left sides, respectively, of the cutter apparatus. In example embodiments, the guard includes multiple workpiece contact portions (mutually exclusively) associated with the multiple different cutter apparatus configurations, respectively. In example embodiments, the housing and the handle are tool-lessly reconfigurable.

In example embodiments, a cutter (or cutter apparatus) is reconfigurable (e.g., in relation to a gripping interface, surface, or structure) in multiple different cutter configurations and includes multiple cut guards (or cut guides) positioned for contact with a workpiece depending upon the cutter configuration. In example embodiments, at least one of the multiple cut guards is positioned for contact with a workpiece for each of the configurations. In example embodiments, a different cut guard is positioned for contact with a workpiece for each of the configurations.

One or more of the guards is configured, for example, such that the cutter can be slid along the top of a box, allowing the top of the box to be removed more easily and safely with less risk of damage to merchandise inside. A guard on either side of the knife, as described herein, facilitates ambidextrous operation.

Figure 2A:
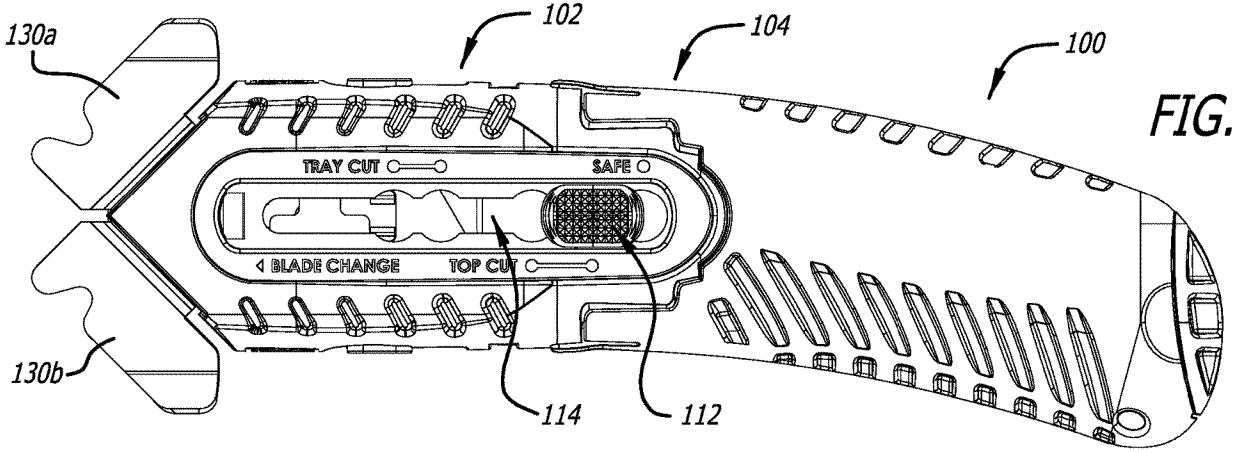
FIGS. 2A and 2B are left and right sides views, respectively, of the cutter apparatus of FIG. 1.
Figure 2B:
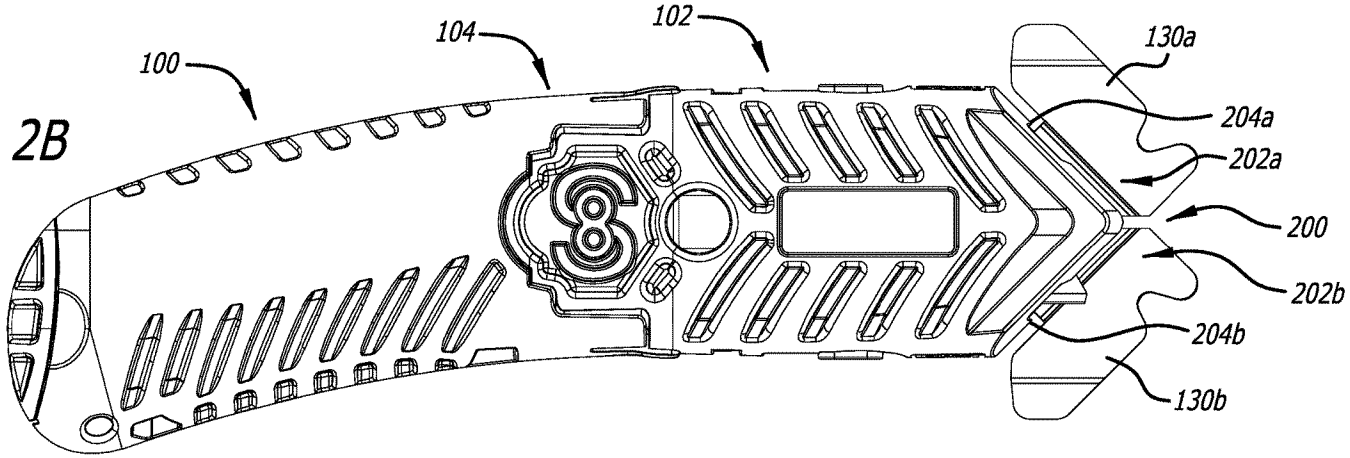

Referring to FIGS. 2A and 3, in this example embodiment, the housing portion (or distal portion) 102 includes or is provided with an opening 200 at least partially defined by surfaces (or other portions) of the housing (e.g., symmetrical surfaces) that face different directions, respectively. In this example embodiment, distal end portions 202*a* and 202*b* form or provide a V-shaped end portion of the housing (e.g. as shown). In this example embodiment, the cut guards 130*a* and 130*b* (mirror images of each other) are positioned adjacent to the distal end portions 202*a* and 202*b*, respectively.

Thus, in an example embodiment, a cutter apparatus includes a distal portion including a housing with an opening, a blade carrier coupled to and repositionable in relation to the housing, and multiple cut guards (or cut guides), and a proximal portion coupled to the distal portion such that the portions are repositionable in relation to and interfit with each other in multiple different configurations in which the portions are secured together and a different cut guard is positioned for contact with a workpiece for each of the configurations.

In example embodiments, the distal portion is or includes a guide for an actuator/slider configured for repositioning the blade carrier. The cutter apparatus can include, for example, an actuator (e.g., a slider) coupled to the housing and configured to allow a user of the cutter apparatus to reposition the blade carrier, and an actuator guide (e.g., a slider guide) secured to the housing. One or more of the cut guards and the actuator guide can be, but are not necessarily, integrally formed.

In example embodiments, the opening is defined at least in part by a two (symmetrical) end portions (e.g., substantially flat/planar surfaces) of the housing that face the opposing guards, respectively.

In example embodiments, the cut guards are fixedly positioned (e.g., secured together) in relation to each other (and in relation to the housing). The multiple cut guards include, for example, two cut guards positioned at opposite sides (or portions) of the housing. In this example embodiment, the cut guards 130*a* and 130*b* are positioned adjacent to opposite ends 204*a* and 204*b*, respectively, of the opening 200.

The proximal portion includes, for example, a handle with a bottom side (e.g., with a curved ergonomic shape configured to be held by the inside of the user's fingers opposite the knuckles during a cutting operation) and, for each of the configurations, one of the cut guards is positioned adjacent to a side (or portion) of the housing that is contiguous and/or in alignment with the bottom side of the handle and the other guard is positioned adjacent to a top side of the cutter apparatus.

Figure 20:
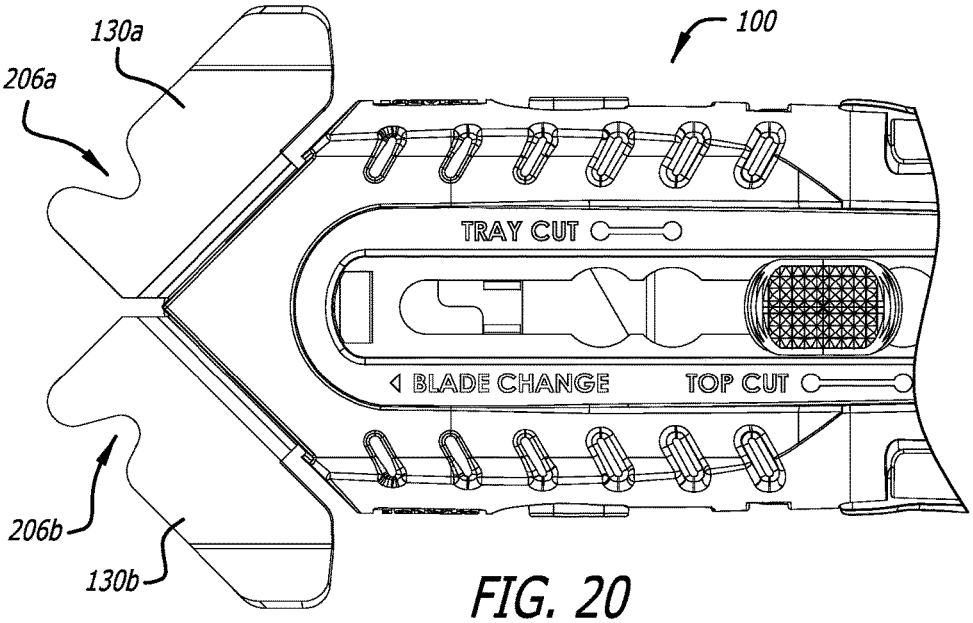
FIG. 20 is a partial side view of the cutter apparatus of FIG. 1 showing opposing cut guards of the guard structure and their respective recessed portions.
Figure 21:
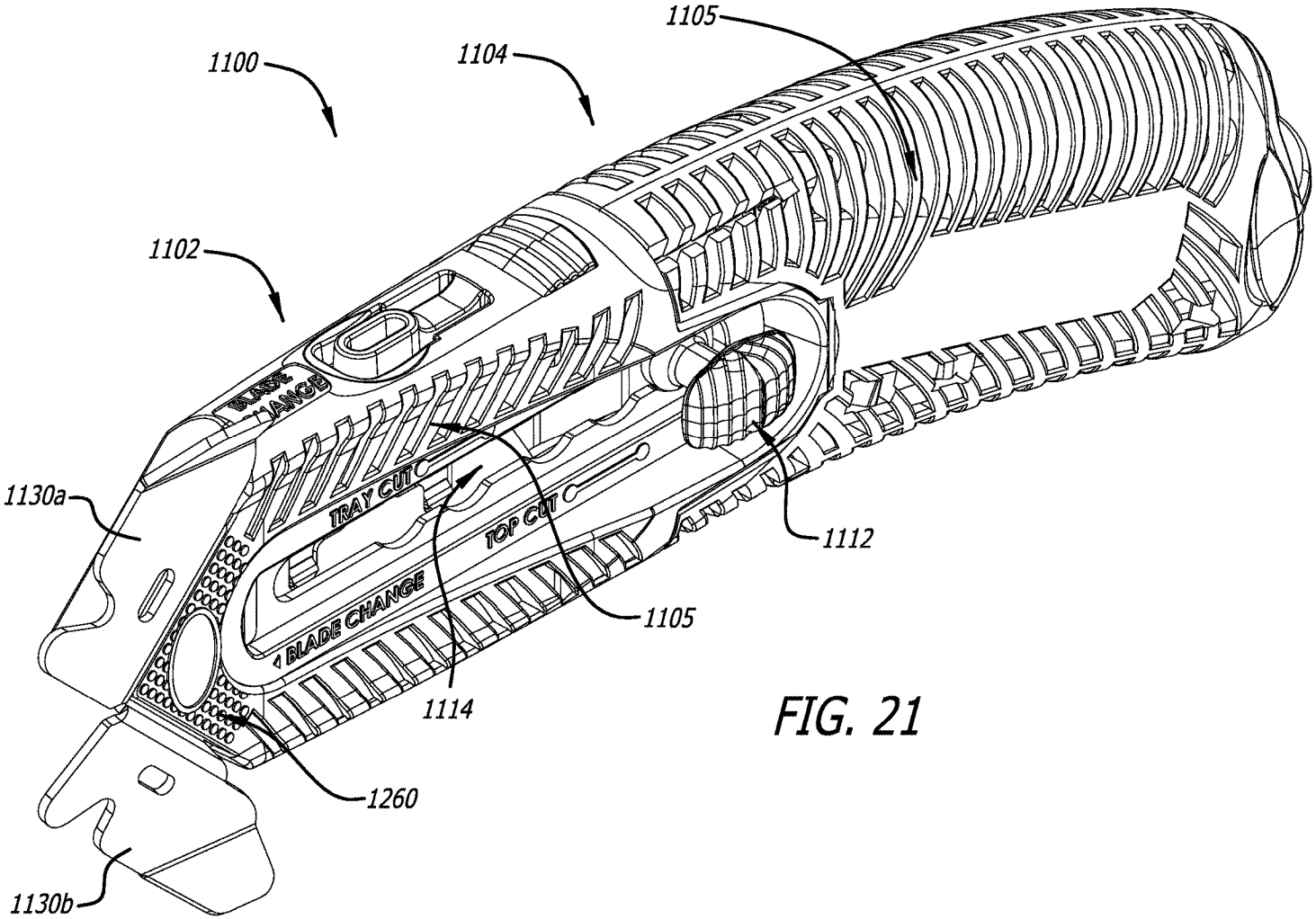
FIG. 21 is a perspective view of another example embodiment of a cutter apparatus.

One or more of the cut guards (e.g., all of the cut guards) can include a recessed portion (i.e., a tape splitter) that faces the workpiece when the cut guard is in a configuration in which it is positioned for contact with the workpiece. A tape splitter formed into each guard allows taped boxes to be opened without exposing the blade, reducing the risk of accidental cuts. Referring to FIG. 20, in this example embodiment, the cut guards 130*a* and 130*b* include or are provided with recessed portions 206*a* and 206*b* (e.g., contoured as shown), respectively.

In example embodiments, a cutter apparatus includes a housing, a blade holder coupled to the housing, and multiple guards coupled to the housing, at least two of the guards being fixed in position in relation to each other and/or in relation to a distal portion of the housing, the housing including distal and proximal portions that are repositionable in relation to each other in multiple different configurations in which the portions are secured together and a different guard is positioned for contact with a workpiece for each of the configurations. In example embodiments, for each of the configurations, one of the guards is positioned adjacent to a side of the housing that is adjacent to a bottom side of the cutter apparatus. In example embodiments, at least one of the guards includes a recessed portion that faces the workpiece when the guard is in a configuration in which the guard is positioned for contact with the workpiece.

Figure 15:
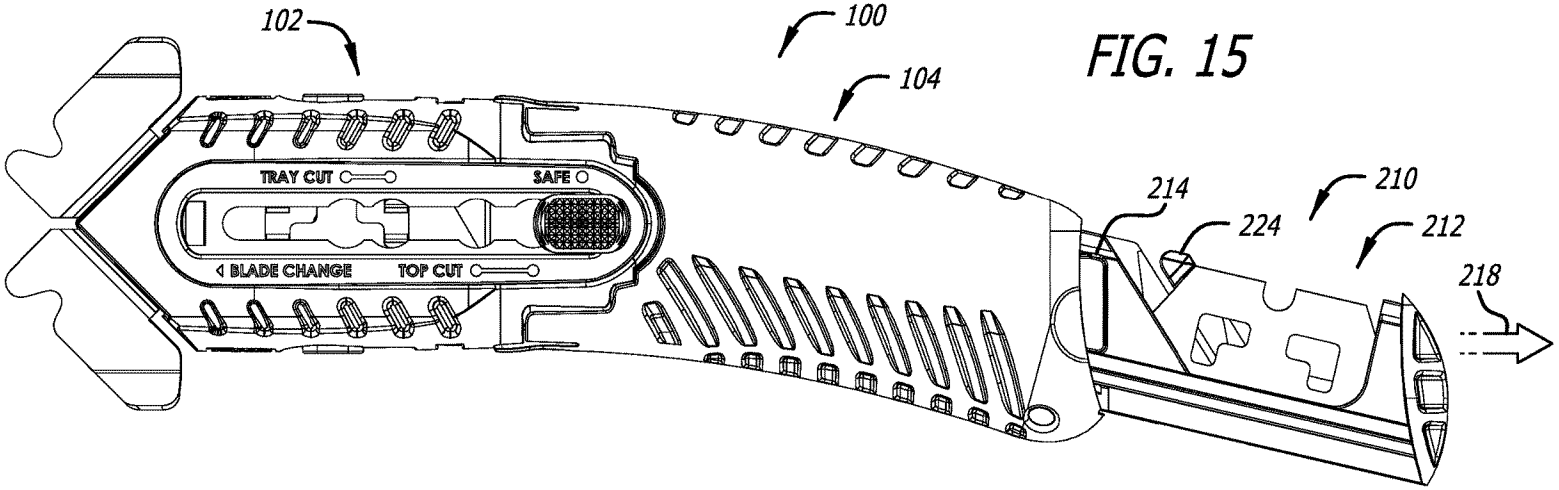
FIG. 15 is a side view of the cutter apparatus of FIG. 1 showing the blade storage assembly repositioned in relation to the handle portion for gaining access to the spare blade holder of the assembly.

Example embodiments of cutters (or cutter apparatuses) include a mechanism or device that facilitates rotatable repositioning of a blade storage assembly about an axis that is parallel or substantially parallel to a longitudinal axis associated with a blade holder and/or a blade of the cutter. Referring to FIGS. 15, 16A, 16B, 17A, 17B, 18A, and 18B, in this example embodiment, the cutter apparatus 100 includes a blade storage assembly 210 that is repositioned in relation to the handle portion 104 for gaining access to a spare blade holder 212 (of the assembly 210). In this example embodiment, the blade storage assembly 210 is coupled (e.g., slidably coupled) to the handle portion 104. The blade storage assembly 210 includes or is provided with upper rails 214*a* and 214*b* and lower rails 216*a* and 216*b* that interface with complementary portions or structures of the handle portion 104, allowing the blade storage assembly 210 to be slidably withdrawn from the base of the handle as denoted by arrow 218 (FIG. 15). By way of example, the blade storage assembly 210 is coupled to the handle portion 104 with a friction fit (e.g., of sufficient strength to steady the assembly in position and/or resist slight forces imparted, perhaps inadvertently, by a user of the cutter apparatus).

Thus, in an example embodiment, a cutter apparatus includes a housing configured for gripping by a hand, a blade holder and/or a blade coupled to the housing, and a blade storage assembly that is coupled to the housing and rotatably repositionable about an axis parallel or substantially parallel to a longitudinal axis associated with the blade holder and/or the blade. The blade holder and/or the blade can be, for example, slidably supported within the housing and repositionable along the longitudinal axis.

Example embodiments of cutters (or cutter apparatuses) include a blade storage compartment coupled to and repositionable in relation to a portion of the cutter (e.g., a handle portion) and a mechanism or device that facilitates securing blades within the blade storage compartment and preventing the blade storage assembly from being decoupled (or separated) from the portion of the cutter. The blade storage assembly 210 and the handle portion 104 include surfaces (e.g., spring-biased latch elements and complementary engagement surfaces, respectively) that prevent the blade storage assembly from being completely separated from the handle portion.

Figure 16B:
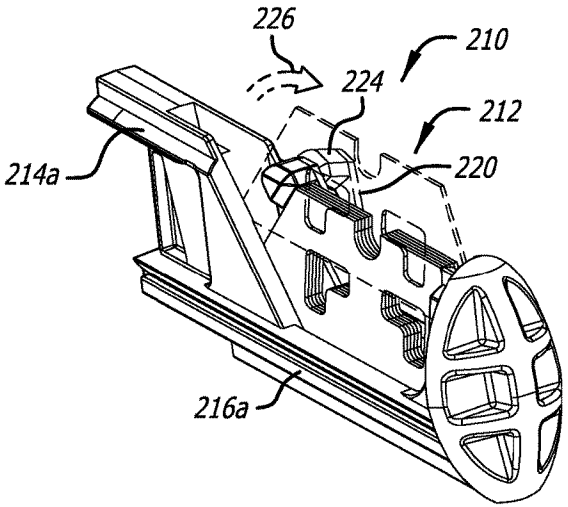
FIG. 16B is another perspective view of the blade storage assembly in which its blade retention spring is shown repositioned in relation to the blade storage compartment for allowing a user of the cutter apparatus to withdraw a blade from the blade storage compartment.
Figure 16A:
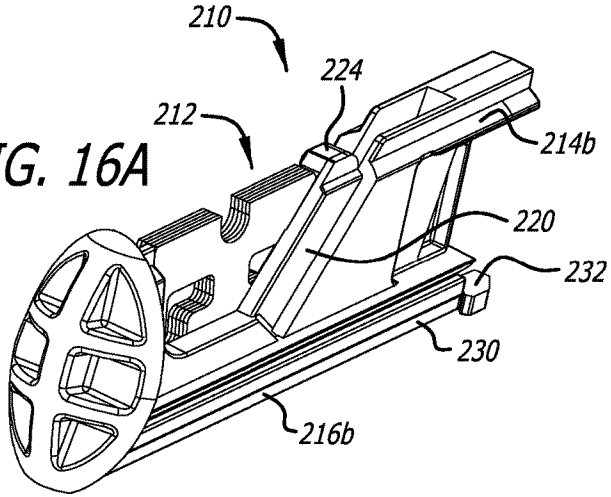
FIG. 16A is a perspective view of the blade storage assembly of the cutter apparatus of FIG. 1.
Figure 17A:
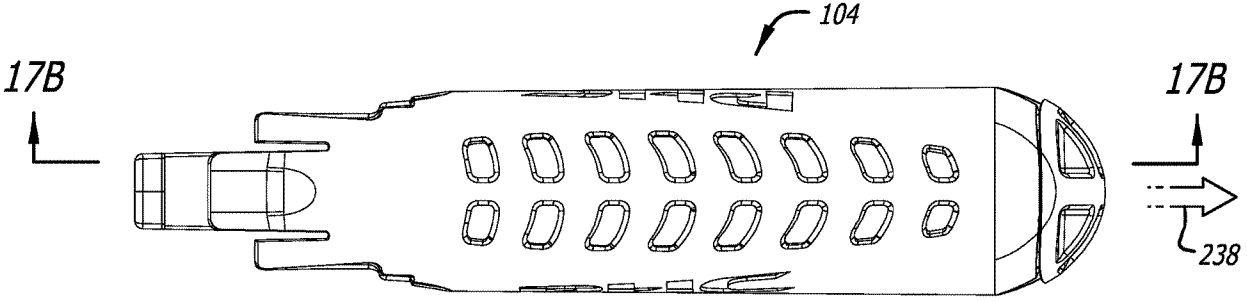
FIG. 17A is a top view of the handle portion of the cutter apparatus of FIG. 1 in which the blade storage assembly is shown in its fully retracted secured closed position.
Figure 17B:
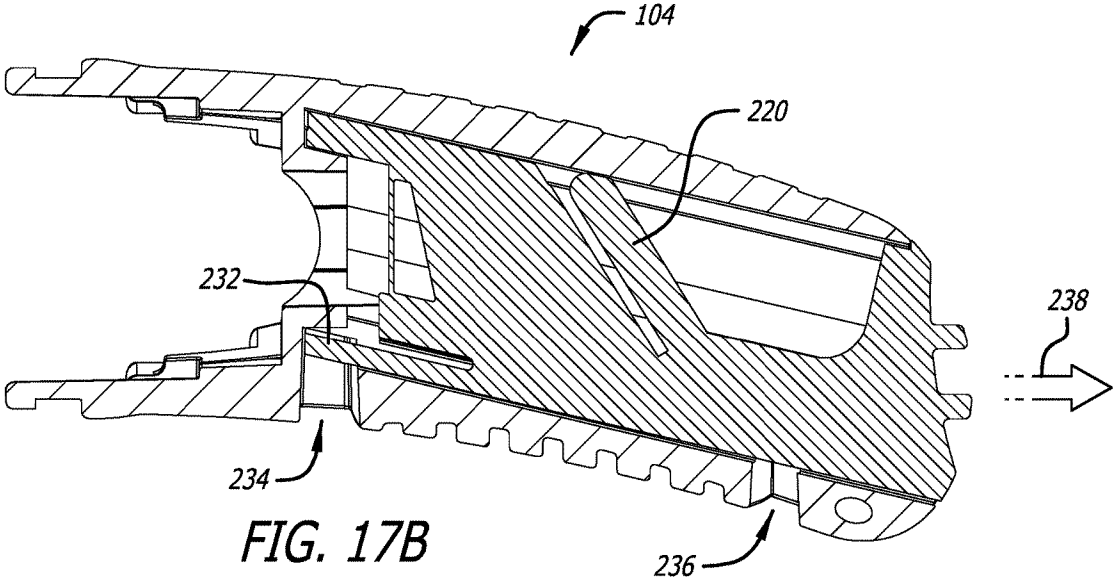
FIG. 17B is a cross-sectional view of the handle portion along lines 17B-17B of FIG. 17A.
Figure 18A:
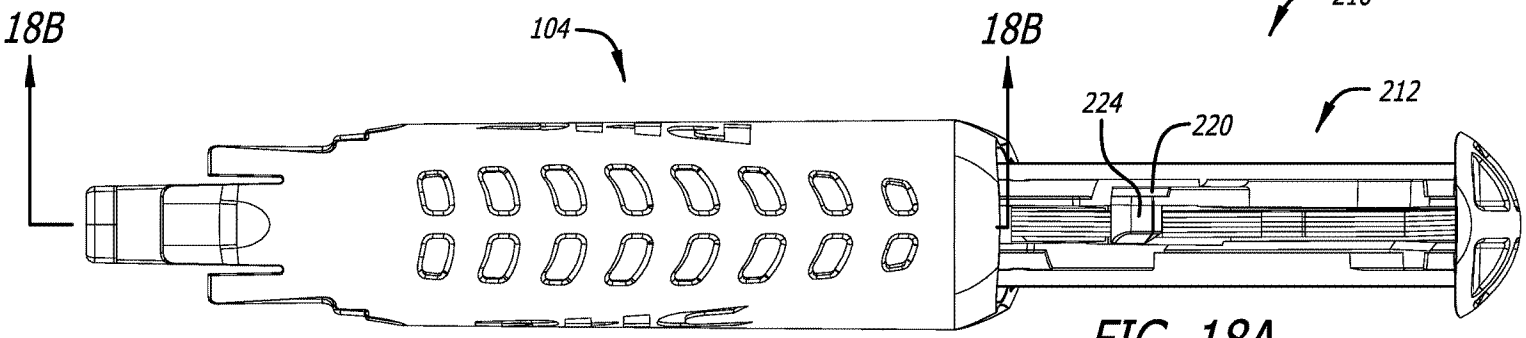
FIG. 18A is a top view of the handle portion of the cutter apparatus of FIG. 1 in which the blade storage assembly is shown in its fully extended secured open position.
Figure 18B:
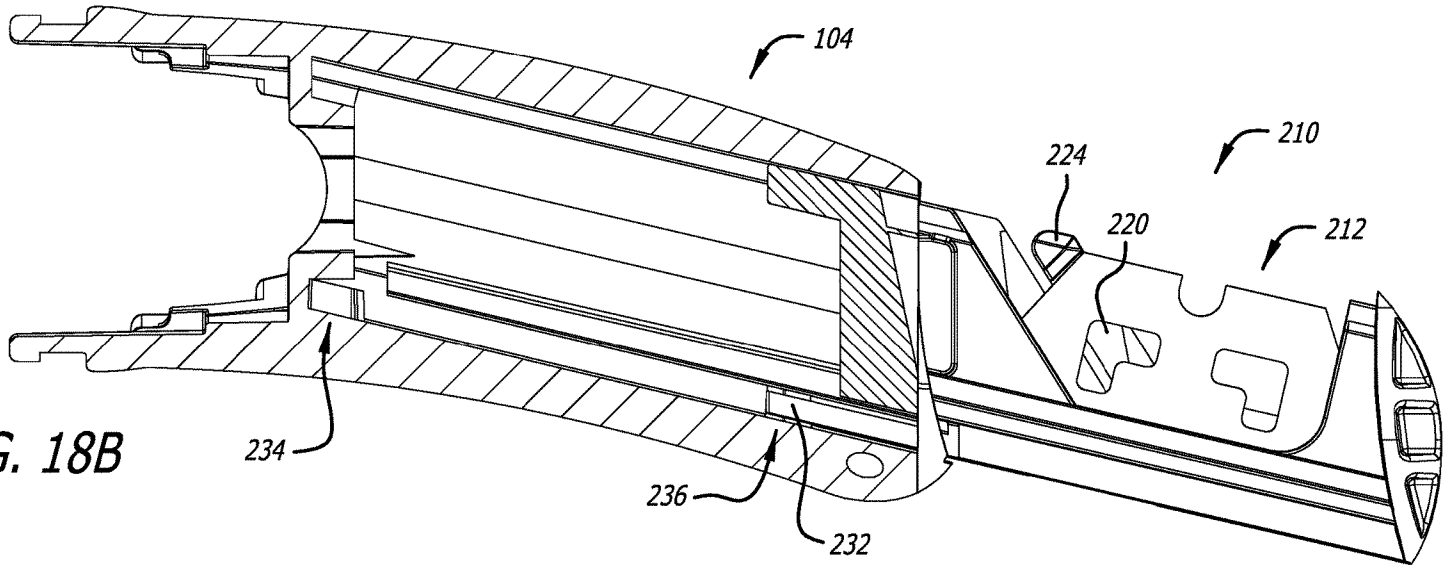
FIG. 18B is a cross-sectional view of the handle portion along lines 18B-18B of FIG. 18A.

The blade storage holder (or compartment) 212 is configured for holding spare blades (e.g., five blades) and includes a plurality of springs (or other biasing components) configured, for example, to perform one or more of: securing blades within the blade storage compartment, controlling how many blades can be simultaneously withdrawn from the blade storage compartment, providing resistance to extending the blade storage assembly from the housing (e.g., during an initial/partial segment of the repositioning movement), and preventing the blade storage assembly from being completely removed from the housing (e.g., via positive lock with the housing). Referring to FIGS. 16A and 16B, in this example embodiment, the plurality of springs includes a first spring 220 (e.g., a plastic spring molded in the blade storage compartment) configured to secure blades within the blade storage compartment (e.g., prevent the blades from falling out) and control how many blades can be simultaneously withdrawn from the blade storage compartment (e.g., only allow withdrawal of one blade at a time). The spring 220 includes a blade retention portion 224 (e.g., with surfaces/portions shaped and configured as shown). In FIG. 16B, the spring 220 is shown (in dashed lines) repositioned in relation to the blade storage compartment 212 as denoted by arrow 226 for allowing a user of the cutter apparatus to withdraw a blade from the blade storage compartment. In this example embodiment, the plurality of springs includes a second spring 230 (e.g., a plastic spring at the base of the spare blade compartment) configured to provide resistance to extending the blade storage assembly from the housing (e.g., latches into the rear body to provide resistance for extending the spare blade compartment) and prevent the blade storage assembly from being completely removed from the housing (when the assembly is extended to gain access to the blade storage compartment). The spring 230 includes an engagement portion (or latch) 232 (e.g., with surfaces/portions shaped and configured as shown), and the handle portion 104 includes recesses 234 and 236 configured to receive the engagement portion 232 therein. Referring to FIGS. 17A and 17B, when the blade storage assembly 210 is in its fully retracted closed position, the engagement portion 232 detents into recess 234 securing the assembly in position until (employing sufficient force to overcome the detent resistance) a user of the cutter apparatus 100 withdraws the assembly as denoted by arrow 238. Referring to FIGS. 18A and 18B, when the blade storage assembly 210 is repositioned to its fully extended opened position, the engagement portion 232 detents into recess 236 securing the assembly for withdrawing a blade from and/or reloading the blade storage compartment 212.

Thus, in an example embodiment, a cutter apparatus includes a housing configured for gripping by a hand, a blade holder and/or a blade coupled to the housing, and a blade storage assembly coupled to and repositionable in relation to a portion of the housing, the blade storage assembly including a blade storage compartment configured for holding spare blades and a plurality of springs configured to secure blades within the blade storage compartment and prevent the blade storage assembly from being completely removed from the housing.

Referring to FIGS. 21, 22A, 22B, 23, and 24, in another example embodiment, a cutter apparatus 1100 includes a housing portion (or body front) 1102 and a handle portion (or body rear) 1104 configured to be coupled or interfitted in multiple different cutter apparatus configurations. The housing portion 1102 and the handle portion 1104 differ from the preceding embodiment (described in relation to the cutter apparatus 100), for example, in that they are formed or provided with more pronounced smaller ribbing 1105 (e.g., as shown) and can include a tactile surface area 1260 (e.g., adjacent to the guards 1130*a* and 1130*b* as shown) such as, for example, a pattern or raised dots configured to provide a tactile feel. The housing portion 1102 and the handle portion 1104 can be formed of various materials, for example, a thermoplastic that has high strength, rigidity, and impact resistance (e.g., Acrylonitrile butadiene styrene (ABS)), and by various processes (e.g., injection molding).

Additionally, the handle portion 1104 differs from the preceding embodiment (described in relation to the cutter apparatus 100) in that it includes side wall openings 1234*a*, 1235*a*, and 1236*a* and opposing side wall openings 1234*b*, 1235*b*, and 1236*b* on its left and right sides, respectively. Additionally, as described below in greater detail, the blade storage assembly 1210 utilizes an engagement mechanism that includes springs in the form of hooks 1232*a* and 1232*b* configured to operate in conjunction with adjacent protrusions 1233*a* and 1233*b*, respectively, for securing/locking the blade storage assembly (blade shuttle) in multiple different positions in relation to the handle portion (rear body) via engagement with the side wall openings.

Additionally, as described below in greater detail, the cutter apparatus 1100 utilizes a modified scoop design (at a base portion of the cutter apparatus) providing engagement portions 1240*a* and 1240*b* configured to be grasped by a user for repositioning (pulling or pushing) the blade storage assembly in relation to the housing.

The handle portion 1104 is coupled to the housing portion 1102 via an engagement interface 1106 (e.g., configured as shown). In this example embodiment, the engagement interface 1106 is configured to allow a user of the cutter apparatus 1100 to selectively interfit together the housing portion 1102 and the handle portion 1104 in multiple different cutter apparatus configurations. As described below in greater detail, the engagement interface 1106 differs from the preceding embodiment (described in relation to the cutter apparatus 100), for example, in that it includes a button locking mechanism that has been modified (i.e., a different press button configuration at both the top and bottom sides of the cutter apparatus 1100) to provide more locking force in four directions. Additionally, as described below in greater detail, the engagement interface differs from the preceding embodiment (described in relation to the cutter apparatus 100), for example, in that it includes a rear body counter twisting mechanism that has been modified to provide, among other things, more rotational mobility.

The cutter apparatus 1100 includes a channel/guard structure 1108 secured to the housing portion 1102 (e.g., fixedly secured by complementary surfaces or portions of the housing) and a blade carrier (or blade holder) 1110 with a blade activation button 1112. In this example embodiment, the channel/guard structure 1108 includes or defines a channel 1109 configured to support the blade carrier 1110 such that the blade carrier 1110 is repositionable along the channel 1109. The channel/guard structure 1108 differs from the preceding embodiment (described in relation to the cutter apparatus 100), for example, in that it includes a guard design that has been modified to remove the locking tabs and add radius 1107, and such that an actuator guide portion 1132 includes or is provided with rails 1133 having increased width. The channel/guard structure 1108 can be formed of various materials, for example, a material made of or including a metal (or a metal alloy or a plastic) that has high strength and wear resistance (e.g., steel), and by various processes (e.g., progressive die stamping). The blade carrier 1110 differs from the preceding embodiment (described in relation to the cutter apparatus 100), for example, in that it includes a spring arm 1116 with a blade/carrier arm 1117 (which supports the blade activation button 1112) that is curved at its tail end for ease of front end assembly. Additionally, the blade carrier 1110 differs from the preceding embodiment (described in relation to the cutter apparatus 100), for example, in that it includes a blade/carrier bending wall structure 1119 that is increased in size along the structure (or juncture) 1119 to facilitate different and/or improved performance. Additionally, as described below in greater detail, the blade carrier 1110 differs from the preceding embodiment (described in relation to the cutter apparatus 100), for example, in that it includes lancets 1121 configured with chamfers 1125 to better retain the blade (e.g., chamfers added to the corners to reduce tight fit of the blade). The blade carrier 1110 can be formed of various materials, for example, a material made of or including a metal (or a metal alloy or a plastic) that has high strength and wear resistance (e.g., stainless steel), and by various processes (e.g., progressive die stamping).

The blade activation button 1112 differs from the preceding embodiment (described in relation to the cutter apparatus 100), for example, in that it utilizes ridges 1123 configured to improve the ease with which the button 1112 is activated (i.e., easer for the thumb to activate it). The blade activation button 1112 can be formed of various materials, for example, a zinc alloy (e.g., Zamak 2), and by various processes (e.g., die cast).

Figure 24:
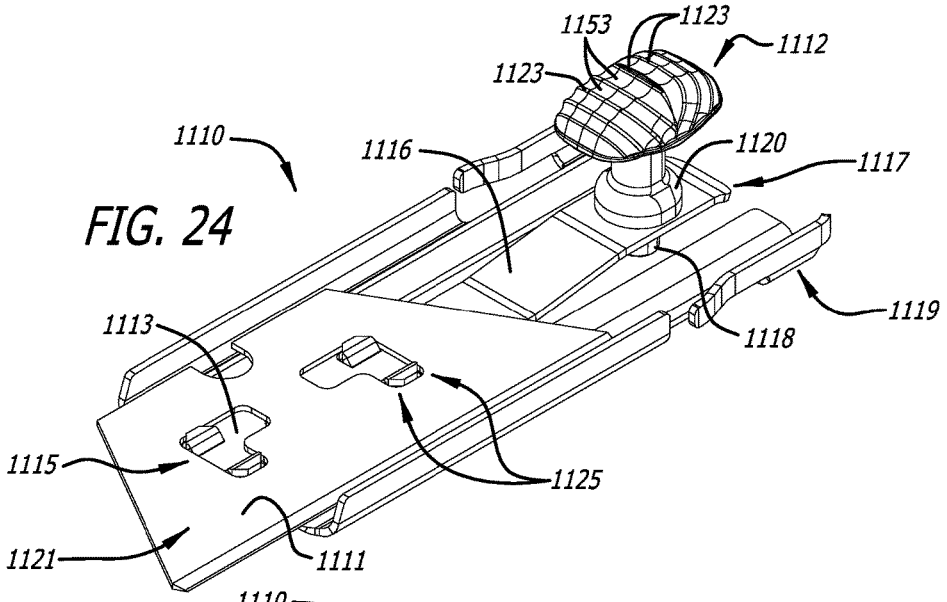
FIG. 24 is a perspective view of the blade carrier and the blade activation button of FIG. 23 shown assembled and with a blade positioned on the blade carrier.
Figure 24A:
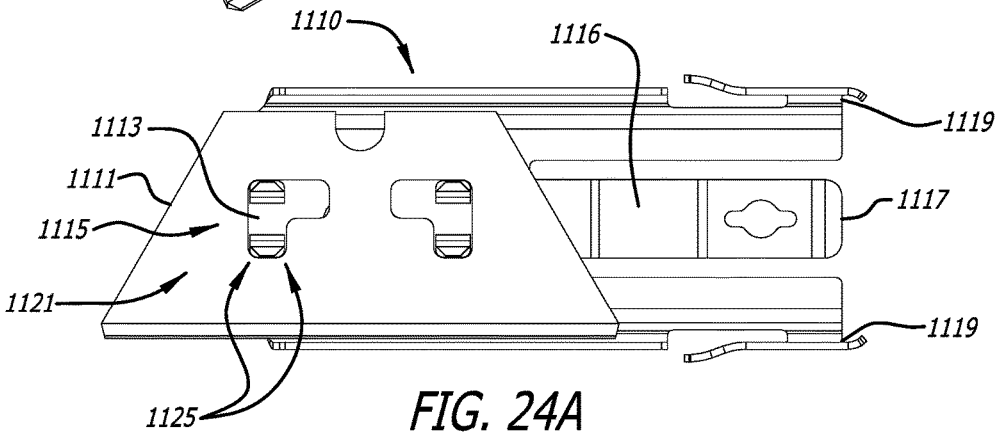
FIGS. 24A and 24B show a pair of cutting edge orientations that are mirror images of each other.
Figure 24B:
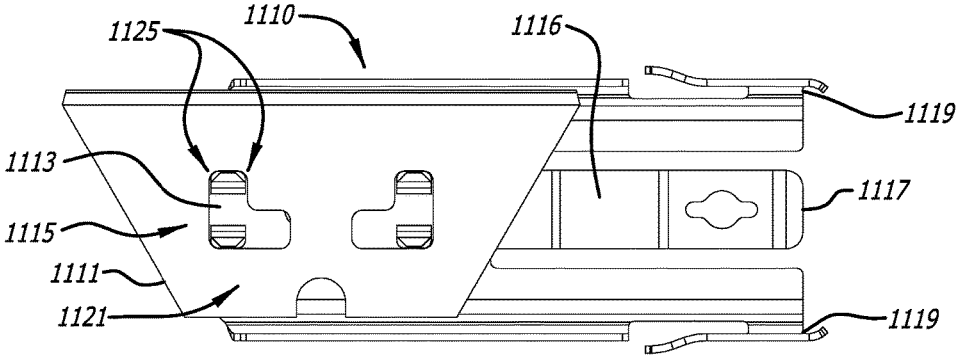

Example embodiments of cutters (or cutter apparatuses) include a mechanism or device that facilitates a low profile blade actuator that can be dependably and comfortably engaged by a thumb from many different angles. Referring additionally to FIGS. 24A and 24B, in this example embodiment, the ridges 1123 (of the blade activation button 1112) include a series of smooth continuous ridge lines (e.g., including one or more parallel or substantially parallel ridge lines). In this example implementation, the ridge lines curve (e.g., as shown) at side portions of the button. The blade activation button 1112 can include channels 1153 (e.g., between the ridges). For example, the blade activation button 1112 can include channels (e.g., a series of channels) defined at least in part by curved portions of the button between the ridges (or ridge lines).

Thus, in an example embodiment, a cutter apparatus includes a handle, a blade carrier coupled to the handle and repositionable in relation to the handle, and a slider button coupled to the blade carrier such that a blade held by the blade carrier is extendable from the handle when the button is deployed, the slider button including a series of ridges (or ridge lines) that extend across the slider button (e.g., curving toward the handle at opposite sides thereof). In example implementations, the ridges extend across the slider button curving toward the handle at opposite sides of the button. In example implementations, the ridges include surfaces (e.g., substantially continuous surfaces) therebetween defining a series of channels (e.g., curved channels).

Referring to FIGS. 24A and 24B, in this example embodiment, the blade carrier 1110 is configured to hold a blade 1111 in multiple different cutting edge orientations (e.g., with the blade 1111 secured between the blade carrier 1110 and one or more portions of the channel/guard structure 1108). In this example embodiment, the blade carrier 1110 and a blade 1111 are configured such that the multiple different cutting edge orientations include a pair of mirror image cutting edge orientations.

In example embodiments, the blade carrier 1110 and the blade 1111 are configured with symmetrical complementary engagement portions. By way of example, a substantially flat surface (or portion) 1113 of the blade carrier 1110 includes or is provided with protrusions 1115 (e.g., fixed tabs or other raised structures shaped and positioned as shown) configured to accommodate positioning the blade 1111 adjacent to the substantially flat surface 1113 with the protrusions 1115 extending through one or more apertures in the blade and/or engaging complementary surfaces of the blade preventing the blade from repositioning along the blade carrier 1110.

Example embodiments of cutters (or cutter apparatuses) include a mechanism or device that facilitates reducing tight fit of a blade on the blade holder. By way of example, and with reference to FIGS. 24, 24A, and 24B, the protrusions 1115 can include lancets (or posts) 1121 configured with chamfers 1125 to better retain the blade 1111 (e.g., chamfers provided at corners of a lancet to reduce tight fit of the blade). One or more of the chamfers can be provided in the form of, for example, a beveled surface between and adjoining two side surfaces of a lancet/post.

Thus, in an example embodiment, a cutter apparatus includes a housing, a blade holder coupled to the housing, the blade holder including chamfers configured for retaining a blade on the blade holder (e.g., beveled edges of four lancets/posts on the blade holder). One or more lancets/posts can include chamfers that face away from a center of the blade holder (e.g., in four different directions). For example, the chamfers can be oriented at angles approximately 45° in relation to a cutting edge of a blade when the blade is held on the blade holder. In example embodiments, the chamfers are provided on one or more (e.g., four) lancets (or posts) of the blade holder. The chamfers can include a pair of approximately orthogonal surfaces (e.g., which are both provided on a lancet/post of the blade holder). The chamfers can include multiple pairs of chamfers (e.g., configured such that each pair faces either a cutting edge of the blade or an opposite edge of the blade). The chamfers can be configured such that each such pair faces either a cutting edge of the blade or an opposite edge of the blade independent of an orientation of the blade in relation to the blade holder when the chamfers are positioned within one or more openings of the blade. In example embodiments, the blade holder includes multiple (e.g., four) chamfered surfaces (in a substantially rectangular arrangement), the surfaces each being approximately orthogonal in relation to one or more of the other chamfered surfaces (e.g., in relation to a surface of an adjacent lancet/post of the rectangular arrangement). In example embodiments, the chamfers (e.g., beveled surface portions) are configured to face curved (inward-facing) surfaces of a blade when the blade is secured to the blade holder. The blade holder can include a blade carrier that is coupled to and repositionable in relation to the housing.

Figure 25:
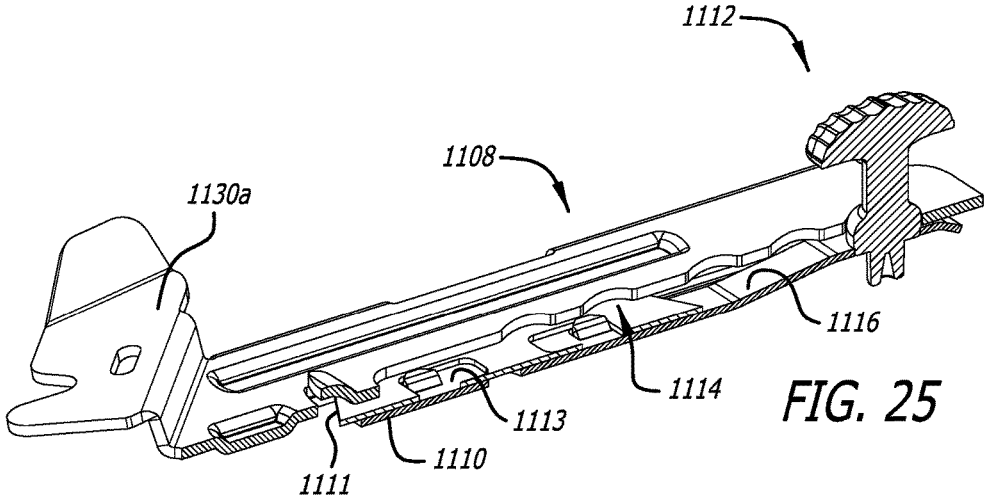
FIG. 25 is a cross-sectional perspective view of the channel/guard structure of FIG. 23 shown with the blade activation button (of the blade carrier) at a safe position along a guide channel (of the channel/guard structure)
Figure 26:
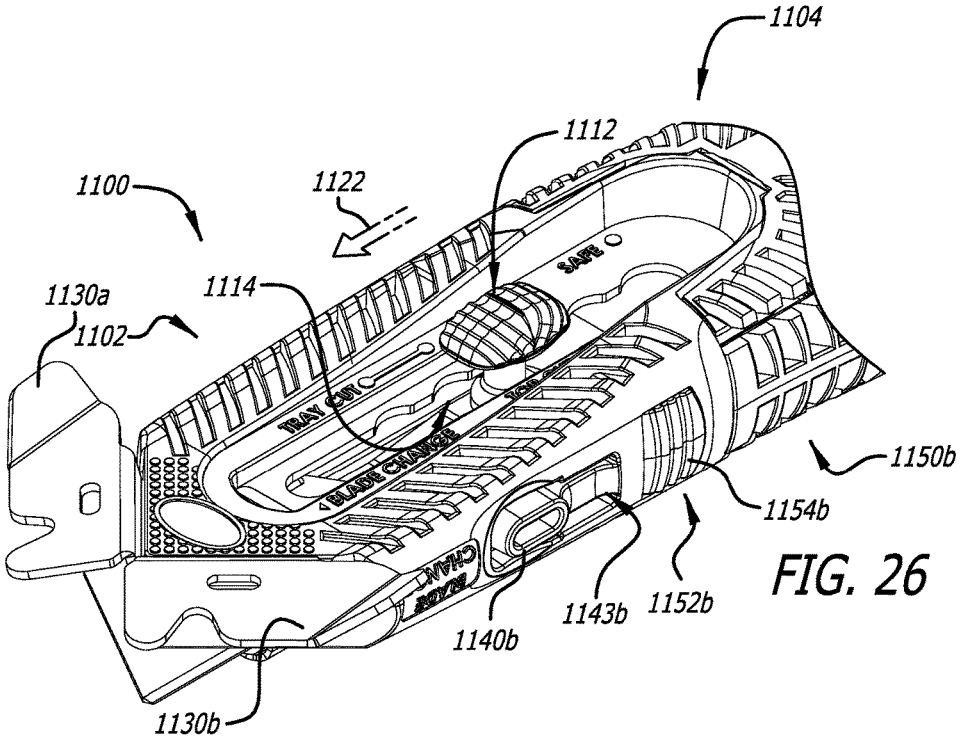
FIG. 26 is a partial perspective view of the cutter apparatus of FIG. 21, the blade activation button is shown repositioning along the guide channel from a top cut position to a tray cut position.

In example embodiments, the blade carrier 1110 is coupled to and repositionable in relation to (e.g., along a channel defined by) the channel/guard structure 1108 and/or one or more other portions or components of the cutter apparatus 1100. In this example embodiment, the channel/guard structure 1108 includes or is provided with a guide channel 1114 (e.g., as shown) and the blade carrier 1110 includes or is provided with a spring member 1116 or other biasing component or element (e.g., a resilient portion of the blade carrier 1110 extending proximally from the substantially flat surface 1113). A connector element 1118 (e.g., a post) traverses the guide channel 1114 connecting (or otherwise securing or coupling together) the blade activation button 1112 and the spring member 1116 at opposite sides of the guide channel 1114. A bearing portion 1120 of the connector element 1118, biased by the spring member 1116, detents outwardly to engage with the various blade carrier position setting portions (i.e., the wider portions) of the guide channel 1114. In this example embodiment, and referring additionally to FIGS. 25 and 26, the blade carrier position setting portions, starting at the proximal end of the guide channel 1114 and moving toward its distal end, facilitate securing the blade carrier 1110 in a "safe" position (in which the blade 1111 is fully retracted within the housing portion 1102), first and second "top cut" blade extension positions, and first and second "tray cut" blade extension positions, respectively. In FIG. 26, the blade activation button 1112 is shown repositioning (as denoted by arrow 1122) along the guide channel 1114 from the second "top cut" position to the first "tray cut" position.

The blade 1111 is activated by depressing the blade activation button 1112 and sliding the index forward to reposition the blade carrier 1110 forward (or distally) along the channel 1109 (of the channel/guard structure 1108). The spring member 1116 (e.g., a flexible arm on the blade carrier 1110) pushes the blade activation button 1112 up into cutouts in the guide channel 1114. In this example embodiment, there are six depth settings in total: safe, two top cut positions, two tray cut positions, and also (as discussed below) a blade change position.

Example embodiments of cutters (or cutter apparatuses) include multiple guards at least two of which are fixed in position in relation to each other. In example embodiments, the multiple guards include two guards positioned at opposite sides of the cutter (or cutter housing). One or more of the multiple guards can be provided on, secured to, or integrally formed as part of the channel/guard structure 1108.

In example embodiments, the multiple guards include at least two guards that are fixed in position in relation to a distal portion of the cutter. For example, one or more of the guards can be secured to the distal portion in a manner that prevents or discourages or at least does not readily facilitate removal or separation of the guard(s) from the distal portion by a user of the cutter. The multiple guards can additionally, or alternatively, include one or more guards that are detachable.

In example embodiments, a cutter (or cutter apparatus) includes guards that are mirror images of each other (e.g., symmetrical in relation to each other and also in relation to a distal portion of the cutter). In this example embodiment, the channel/guard structure 1108 includes or is provided with two guards 1130*a* and 1130*b* that are mirror images of each other. The guards can be coupled together by a common component or element of the cutter. The guards 1130*a* and 1130*b* can be, for example, integrally formed with an actuator guide portion 1132 (of channel/guard structure 1108) that includes and/or defines the guide channel 1114. In example embodiments, the multiple guards are one or more of directly coupled (e.g., in direct contact with each other), indirectly coupled (e.g., coupled together by one or more intermediary coupling elements or components), continuously coupled (e.g., at all times and/or by a continuous coupling structure or mechanism), and intermittently coupled (e.g., when one or more of the guards is detachable).

Thus, in an example embodiment, a cutter apparatus includes a housing, a blade holder coupled to the housing, and multiple guards coupled to the housing, at least two of the guards being fixed in position in relation to each other and/or in relation to a distal portion of the housing. In example embodiments, the blade holder includes a blade carrier coupled to and repositionable in relation to the housing. Although example embodiments of cutters (or cutter apparatuses) described herein include a blade carrier (or blade holder) that is configured to be repositionable (e.g., in relation to the cutter housing), the scope of the present invention(s) additionally includes and/or contemplates cutters (or cutter apparatuses) with a blade holder that is coupled to the housing, but not repositionable (e.g., a fixed blade).

Example embodiments of cutters (or cutter apparatuses) include a blade carrier (or other component or element of the cutter) that is repositionable in relation to a portion of the cutter and multiple safety actuators configured to facilitate an action or process of disengaging one or more interlocks that prevent the blade carrier (or other component or element of the cutter) from being repositioned (e.g., for a blade change operation). The multiple (e.g., two or more independently repositionable) safety actuators can be configured to disengage the one or more interlocks, for example, when a plurality of the safety actuators are activated (e.g., two or more, or all of the safety actuator, are simultaneously in an activated state).

Figure 27:
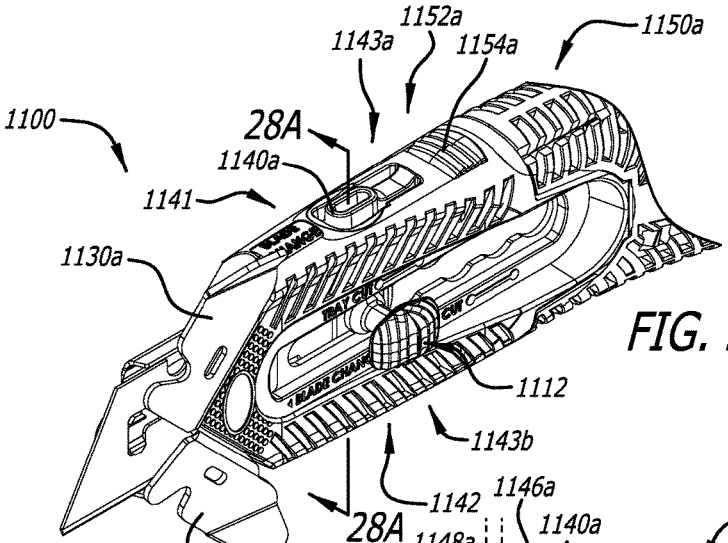
FIG. 27 is a partial perspective view of the cutter apparatus of FIG. 21 in which the blade carrier and its blade activation button are positioned along the guide channel at a distal-most tray cut position.
Figure 28A:
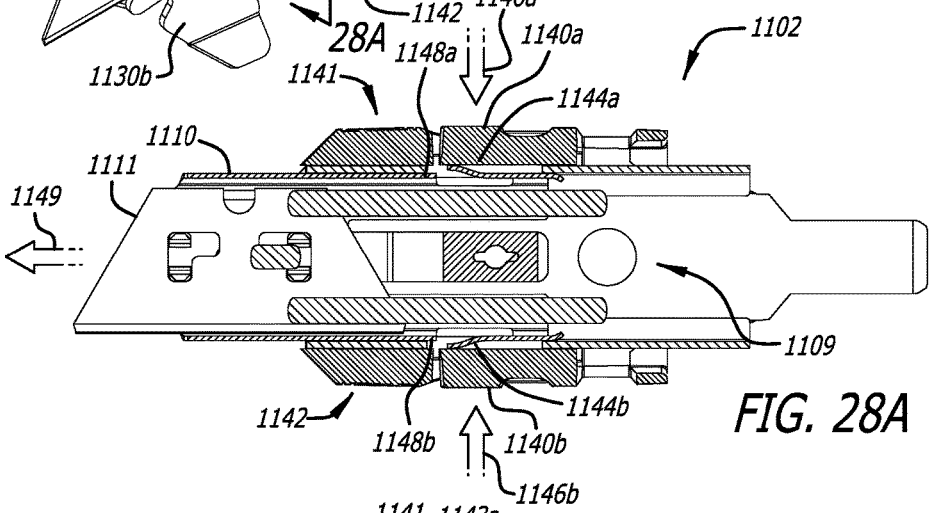
FIG. 28A is a cross-sectional view of the cutter apparatus along lines 28A-28A of FIG. 27 showing dual safety actuators that are repositionable for disengaging interlocks that prevent the blade carrier from being repositioned (extended) to a blade change position.

The safety actuators can include, by way of example, dual actuators configured to function as a Boolean AND operator, i.e., requiring both actuators to be activated in order to release the blade carrier or other component or element of the cutter. Referring to FIGS. 26, 27, and 28A, in this example embodiment, the cutter apparatus 1100 includes safety actuators 1140*a* and 1140*b* located at the top side 1141 and the bottom side 1142, respectively, of the housing portion 1102. The safety actuators 1140*a* and 1140*b* are located within recesses 1143*a* and 1143*b*, respectively, in the housing portion 1102 (e.g., substantially flush with adjacent exterior surfaces of the housing when not activated). The safety actuators 1140*a* and 1140*b* can include or be provided in the form of flexible components (e.g., levers coupled or secured to or integrally formed with the housing portion 1102) configured to be repositionable in relation to the one or more interlocks. The safety actuators 1140*a* and 1140*b* can include or be provided in the form of inflexible, rigid, or partially flexible or resilient components as well as articulated components and associated interconnection mechanisms and devices.

Figure 28B:
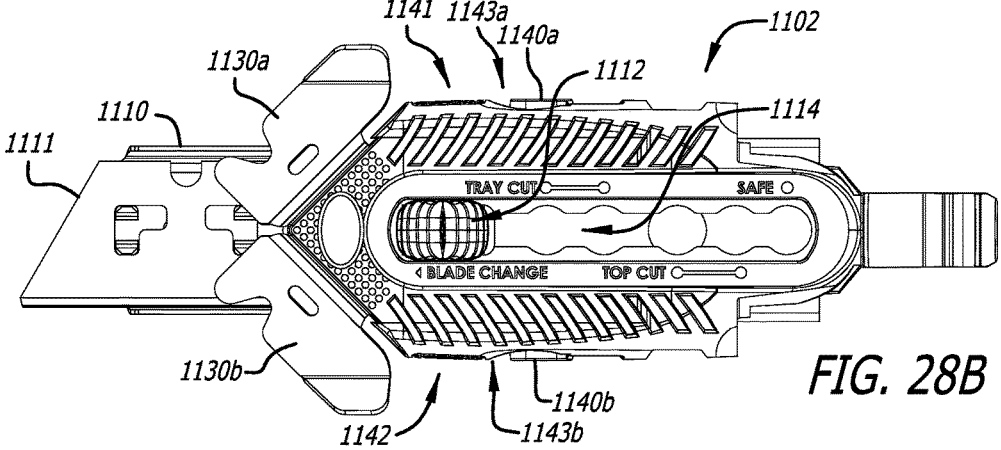
FIG. 28B is a side view of the housing portion of the cutter apparatus of FIG. 21 showing the blade carrier extended from the housing portion to the blade change position.

In example embodiments, the safety actuators are biased to reposition away from the one or more interlocks (the biasing forces being imparted, for example, by the actuators themselves and/or by one or more other components or elements of the cutter). In example embodiments, the one or more interlocks include portions configured to reposition (to respective blade carrier release positions) in response to activation of the safety actuators. Referring to FIGS. 24, 24A, 24B, and 28A, in this example embodiment, the blade carrier 1110 includes engagement elements 1144*a* and 1144*b* (e.g., springs coupled or secured to or integrally formed with the blade carrier 1110) configured to be repositionable (e.g., in relation to surfaces or portions of the channel 1109) in response to activation of the safety actuators as denoted by arrows 1146*a* and 1146*b*, respectively. The engagement elements 1144*a* and 1144*b* reposition inwardly (e.g., flexing laterally in relation to the housing portion 1102), disengaging from cutouts 1148*a* and 1148*b* (of the channel 1109), respectively. When both of the safety actuators 1140*a* and 1140*b* are activated (depressed), the blade carrier 1110 is free to be repositioned (extended distally) as denoted by arrow 1149 to its blade change position (e.g., a distal-most or fully extended position, as illustrated in FIG. 28B, at which the blade activation button 1112 is prevented from further forward movement due to its connector element 1118 contacting the distal end of the guide channel 1114). If either of the safety actuators 1140*a* and 1140*b* is not activated (depressed), its corresponding engagement element interlocks with a cutout in the channel thereby preventing the user from accidentally putting the cutter in the blade change position. After the cutter is in the blade change position, the blade 1111 can be easily removed and replaced.

The multiple safety actuators can include dual blade change levers and/or other repositionable components or elements. In example embodiments, the multiple safety actuators include dual actuators that are symmetrical (e.g., in relation to each other and also in relation to a distal portion of the cutter), positioned at opposite sides of the cutter housing, and/or are configured to activate when repositioned toward each other. The safety actuators can be, but are not necessarily, included or provided as part of the housing.

Thus, in an example embodiment, a cutter apparatus includes a housing, a blade carrier coupled to the housing and repositionable in relation to the housing, and multiple safety actuators configured to disengage, when a plurality of the safety actuators are activated, one or more interlocks that prevent the blade carrier from being repositioned for a blade change operation.

Figure 23:
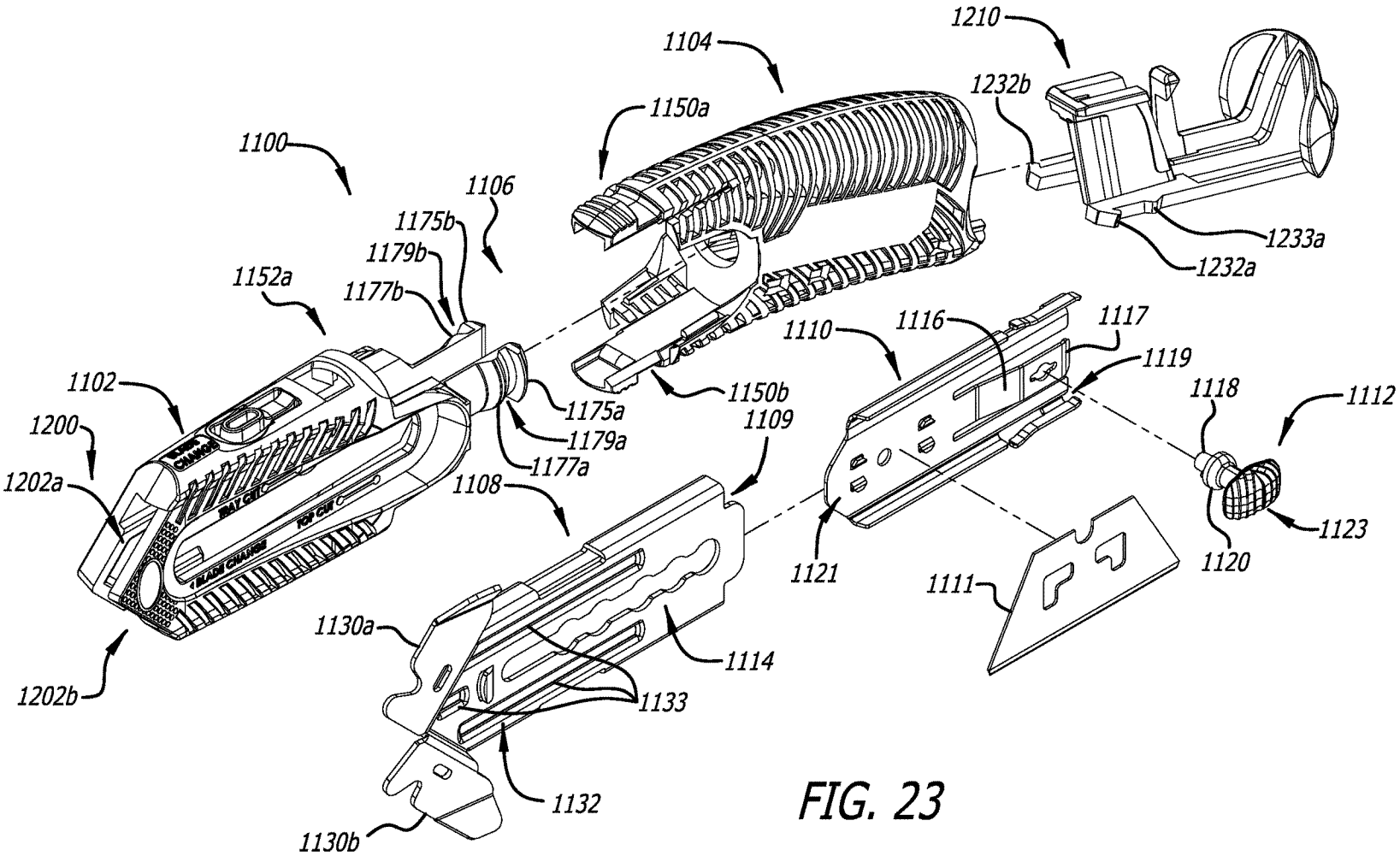
FIG. 23 is an exploded perspective view of the cutter apparatus of FIG. 21.

Example embodiments of cutters (or cutter apparatuses) include a mechanism or device that facilitates ambidextrous (left- and right-handed) operation of the cutter. The mechanism or device can include one or more engagement interfaces, for example, an exterior interface and an interior interface. Referring to FIGS. 23, 26, and 27, in this example embodiment, the handle portion 1104 includes symmetrical dual latches 1150*a* and 1150*b* (e.g., flexible members provided at opposite sides of the distal end of the handle portion 1104) and the housing portion 1102 includes symmetrical openings 1152*a* and 1152*b* (e.g., provided as shown at opposite sides of the housing portion 1102). In this example embodiment, the openings 1152*a* and 1152*b* are formed or otherwise provided at the top side 1141 and the bottom side 1142, respectively. The latches 1150*a* and 1150*b* are received within the openings 1152*a* and 1152*b*, respectively, to secure the housing portion 1102 and the handle portion 1104 together when they are interfitted in either a left-handed configuration or a right-handed configuration. The latches 1150*a* and 1150*b* respectively include tabs 1154*a* or 1154*b* (or other protruding portions or structures) that are configured to engage side portions of the openings when the housing and the handle are secured together. In this example embodiment, the tabs 1154*a* and 1154*b* must both be depressed (pressed inward) in order to unlock the housing and handle portions. In this example embodiment, the latches 1150*a* and 1150*b* are configured to be larger than the latches 150*a* and 150*b* (described in relation to the cutter apparatus 100) and the tabs 1154*a* and 1154*b* include ridges (e.g., as shown) to provide improved locking strength (at the top side 1141 and the bottom side 1142), more secure locking engagement (more locking force in four directions), and a more dependable mechanism for disengaging the latches.

Example embodiments of cutters (or cutter apparatuses) include a housing portion (e.g., a distal portion) and a handle portion (e.g., a proximal portion) that are symmetrical about a first plane and a second plane, respectively. In example embodiments, the first and second planes are orthogonal.

Figure 29:
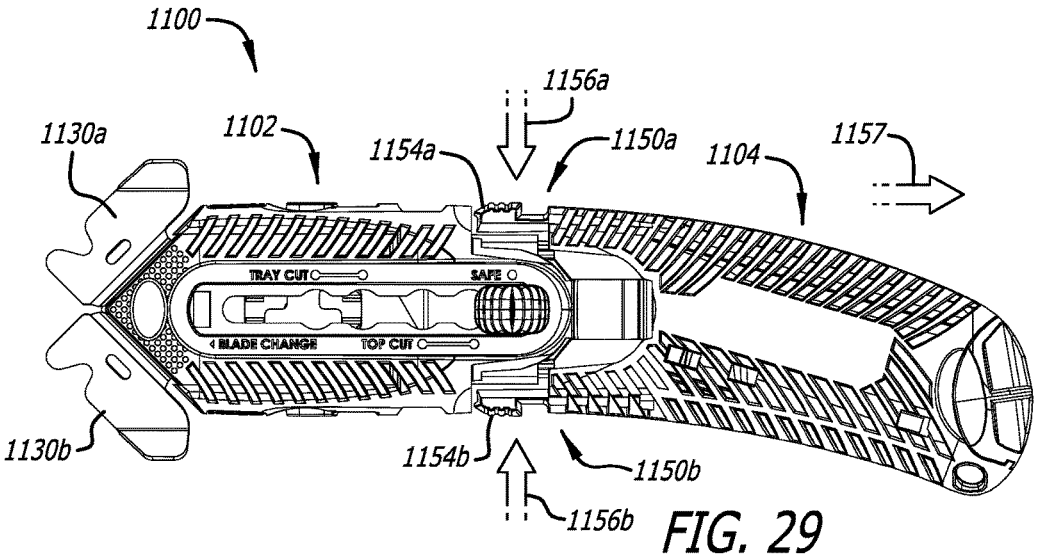
FIG. 29 is a side view of the cutter apparatus of FIG. 21 showing the handle portion disengaged from the housing portion, at an exterior interface defined therebetween, and repositioned sufficiently apart from the housing portion, at an interior interface defined therebetween, such that the handle and housing portions are rotatably repositionable in relation to each other for reconfiguring the cutter apparatus.

Referring to FIG. 29, in this example embodiment, a front body portion (e.g., front half) of the cutter apparatus 1100 is symmetrical about (in relation to) an XZ plane (e.g., passing through the housing portion 1102 and intersecting a point between the guards 1130*a* and 1130*b*) and a rear body portion (e.g., rear half) of the cutter apparatus 1100 is symmetrical about (in relation to) an XY plane (e.g., passing through the handle portion 1104 and intersecting a center point between left and right sides thereof). In conjunction with the blade carrier 1110, which allows the blade 1111 to be selectively positioned in one of a pair of cutting edge orientations that are mirror images of each other, use the cutter apparatus 1100 during a cutting operation utilizing left- and right-handed cutter apparatus configurations as described herein will be identical for left- and right-handed users, respectively.

Thus, in an example embodiment, a cutter apparatus includes a housing, configured for holding a blade, and a handle coupled to the housing via an engagement interface configured to allow a user of the cutter apparatus to selectively interfit together the housing and the handle in multiple different cutter apparatus configurations including a pair of configurations accommodating left and right-handed operation of the cutter apparatus, respectively.

Example embodiments of cutters (or cutter apparatuses) include an engagement interface configured to facilitate selectively interfitting together portions of the cutter in multiple different ergonomic configurations (e.g., in relation to gripping the cutter by hand). The engagement interface can include or be defined, for example, by complementary surfaces (or other portions) of the housing and the handle, respectively. In example embodiments, the engagement interface is configured to permit the handle (e.g., upon release) to be rotatably repositioned in relation to the housing, or vice versa. In example embodiments, the engagement interface includes an exterior (e.g., peripheral) interface configured to automatically lock (or secure) the housing and the handle together when the housing and the handle are repositioned to interfit together in one (any) of the cutter apparatus configurations. In example embodiments, the exterior interface is configured to allow a user of the cutter apparatus to unlock (or disengage) the housing and the handle by actuating multiple release devices provided on one or more of the housing and the handle.

Figure 30:
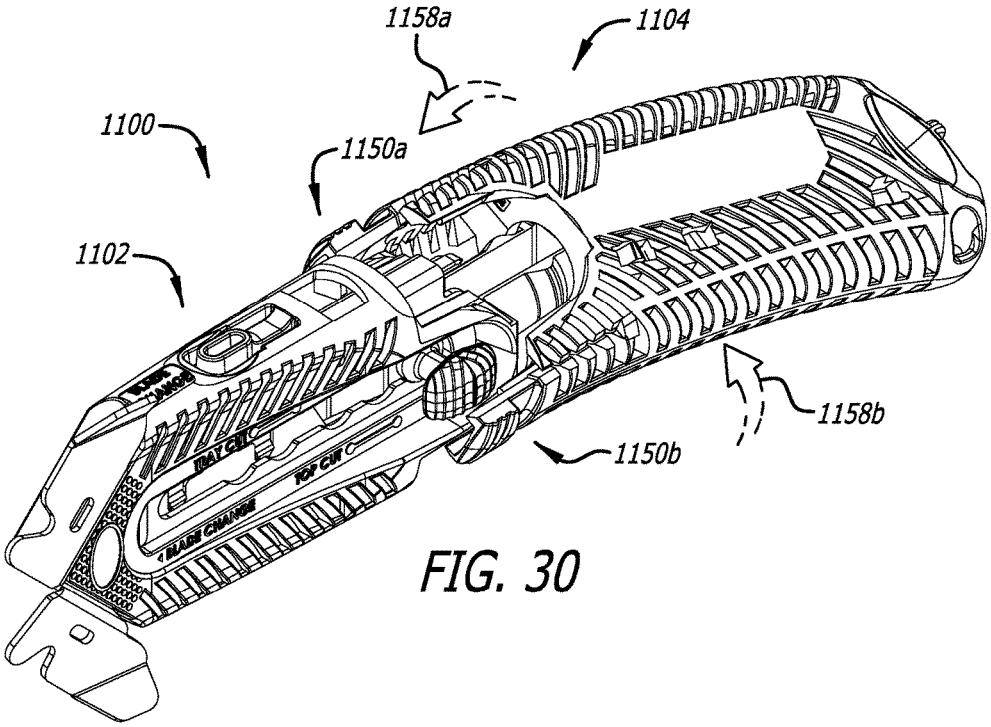
FIG. 30 is a perspective view of the cutter apparatus of FIG. 21 showing the handle portion being rotatably repositioned in relation to the housing portion.
Figure 31:
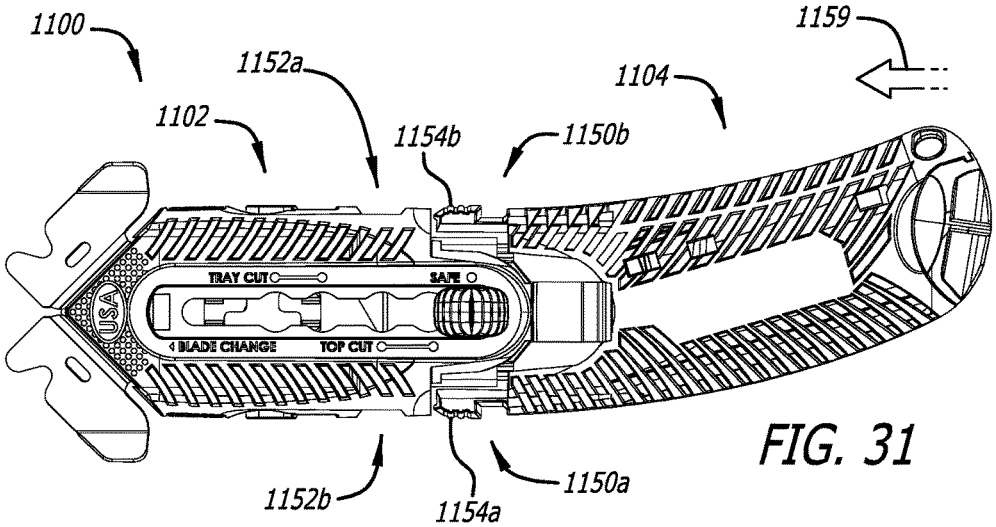
FIG. 31 is a side view of the cutter apparatus of FIG. 21 showing the handle portion repositioned in relation to and aligned for reengagement with the housing portion in a different cutter apparatus configuration.
Figure 32:
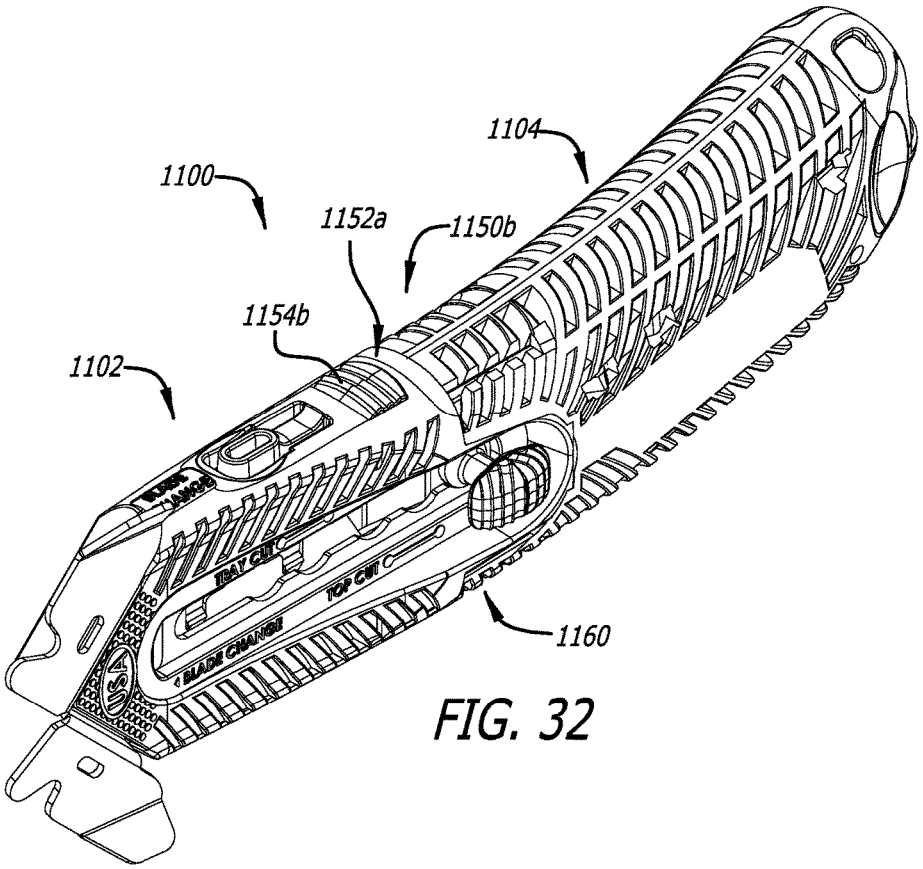
FIG. 32 is a perspective view of the cutter apparatus of FIG. 21 in which the handle portion has been repositioned in relation to and reengaged with the housing portion providing symmetrical cutter apparatus configuration.

Referring to FIG. 29, in this example embodiment, the cutter apparatus 1100 is reconfigurable for use by left- or right-handed users by depressing the tabs 1154*a* and 1154*b* (of the handle portion 1104) as denoted by arrows 1156*a* and 1156*b*, respectively, and sliding the handle portion 1104 back as denoted by arrow 1157. Referring to FIG. 30, with the handle portion 1104 disengaged from the housing portion 1102 and repositioned sufficiently apart from the housing portion 1102, the handle and housing portions can now be rotatably repositioned in relation to each other, e.g., as shown by arrows 1158*a* and 1158*b*, for reconfiguring the cutter apparatus. Referring to FIG. 31, once the handle portion 1104 is repositioned in relation to and aligned for reengagement with the housing portion 1102 in a different cutter apparatus configuration, the handle portion 1104 can be slid forward again as indicated by arrow 1159. Referring to FIG. 32, the handle portion 1104 is shown repositioned in relation to and reengaged with the housing portion 1102 providing a cutter apparatus configuration that is symmetrical to the configuration shown in FIG. 21. An exterior interface 1160 is provided (or defined), for example, by the symmetrical dual latches 1150*a* and 1150*b* (of the handle portion 1104) and the symmetrical openings 1152*a* and 1152*b* (of the housing portion 1102).

Thus, in an example embodiment, a cutter apparatus includes a housing with a blade carrier configured for holding a blade in multiple different cutting edge (or blade) orientations in relation to the housing, the cutting edge orientations including a pair of cutting edge orientations that are mirror images of each other, and a handle coupled to the housing via an engagement interface configured to allow a user of the cutter apparatus to selectively interfit (or connect) together the housing and the handle in multiple different cutter apparatus configurations including a pair of configurations (e.g., predetermined configurations) which, in conjunction with cutting edge orientations respectively selected from the pair of mirror image cutting edge orientations, accommodate ambidextrous operation of the cutter apparatus.

The engagement interface can be configured to allow the housing and the handle to interfit in multiple different predetermined configurations (e.g., two or more predetermined configurations) and/or only in predetermined configurations (e.g., configurations defined or rendered permissible by components or structures of the engagement interface). The engagement interface can be configured to allow the housing and the handle to interfit in multiple different symmetrical configurations (e.g., two or more symmetrical configurations) and/or only in symmetrical configurations (e.g., configurations that are symmetrical in relation to each other, symmetrical in their spacing, and/or symmetrical in relation to a point or location on the cutter.

Example embodiments of cutters (or cutter apparatuses) include an engagement interface with an inner (or central) portion and an outer (or peripheral) portion. In example embodiments, the engagement interface includes an interior interface (e.g., a central interface within the cutter apparatus) configured to couple (e.g., slidably and rotatably couple) the housing and the handle together. In example embodiments, a cutter apparatus includes a housing portion, a handle portion, and an interior interface defined therebetween such that the handle and housing portions are rotatably repositionable in relation to each other for reconfiguring the cutter apparatus. In example embodiments, the engagement interface includes a coupler configured to permit the handle to be rotatably repositioned in relation to the housing. The coupler includes, for example, a channel and a bearing (e.g., included as part of or provided on the handle and the housing, respectively, or vice versa). The bearing is secured or fitted (e.g., snapped-fitted) within and repositionable in relation to (e.g., along) the channel.

Referring to FIGS. 23 and 33-34B, in this example embodiment, the housing and handle portions 1102 and 1104 include a bearing 1162 and a channel 1164, respectively. The bearing 1162 is installed (e.g., snap-fitted) into the channel 1164 and includes one or more engagement surfaces (or portions) configured to be repositionable in relation to the channel 1164 (e.g., along and pivotally within the channel). In this example embodiment, the bearing 1162 is slidably coupled with the channel 1164. An interior interface 1170 is provided (or defined), for example, by the bearing 1162 (of the housing portion 1102) and the channel 1164 (of the handle portion 1104).

Figure 33:
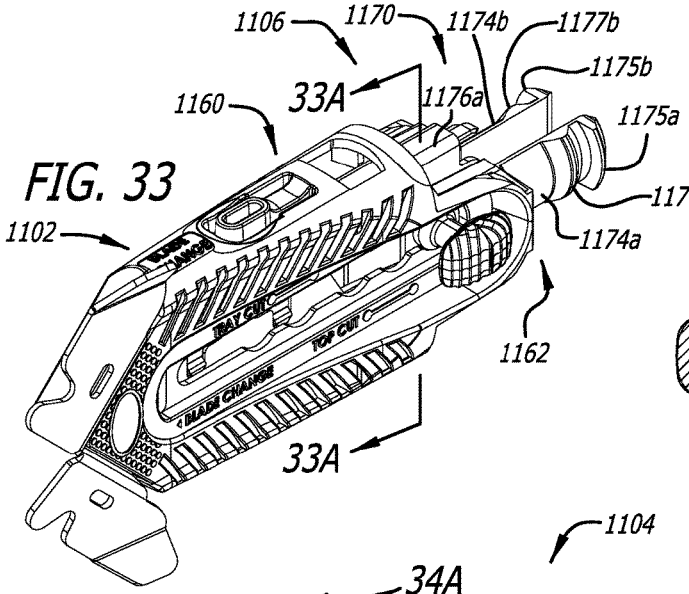
FIG. 33 is a perspective view of the housing portion of the cutter apparatus of FIG. 21.
Figure 33A:
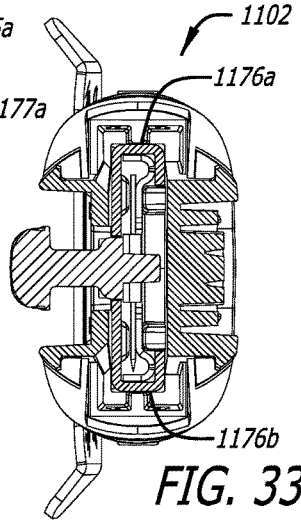
FIG. 33A is a cross-sectional view of the housing portion along lines 33A-33A of FIG. 33.
Figure 34:
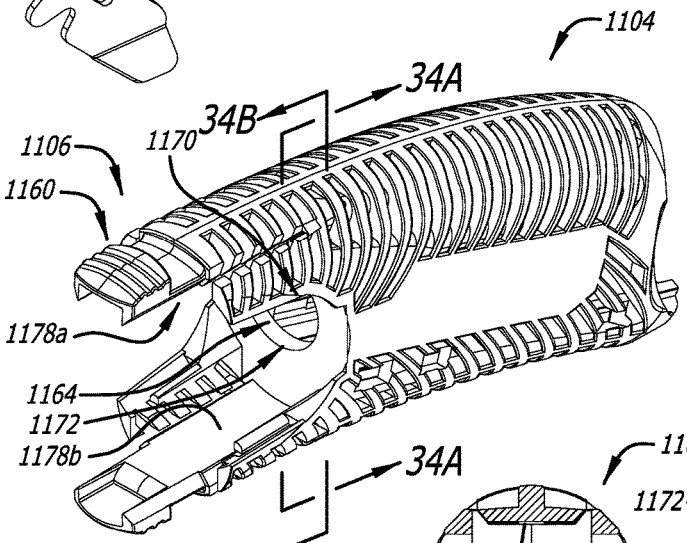
FIG. 34 is a perspective view of the handle portion of the cutter apparatus of FIG. 21.
Figure 34A:
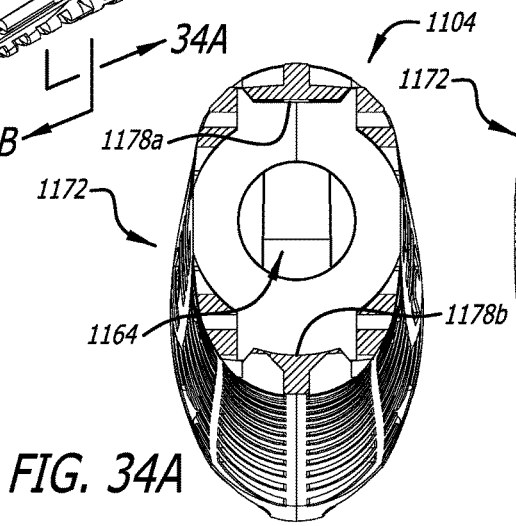
FIG. 34A is a cross-sectional view of the housing portion along lines 34A-34A of FIG. 34.
Figure 34B:
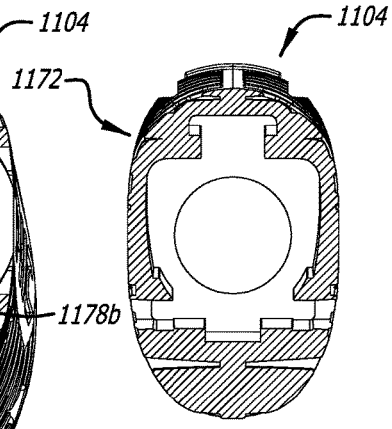
FIG. 34B is a cross-sectional view of the housing portion along lines 34B-34B of FIG. 34.

Example embodiments of cutters (or cutter apparatuses) include a mechanism or device that facilitates multiple different engagement configurations at which housing and handle portions of the cutter are secured together and, when the portions are not in one of the engagement configurations, maintains a coupling arrangement as between the housing and handle portions. To this end, the channel 1164 (e.g., a cylindrical channel or bore) includes or is provided with an inwardly extending annular ridge or ridge structure 1172, and the bearing 1162 includes or is provided with dual symmetrical flexible members 1174*a* and 1174*b* with laterally extending end portions 1175*a* and 1175*b*, respectively, that are fitted into and secured within the channel 1164. Referring to FIGS. 33A and 34, the housing portion 1102 includes symmetrical raised portions 1176*a* and 1176*b*, and the handle portion 1104 includes complementary recessed portions 1178*a* and 1178*b*. The bearing 1162 is installed in the channel 1164 by pressing its flexible members 1174*a* and 1174*b* inward a sufficient amount to allow their respective laterally extending end portions 1175*a* and 1175*b* to reposition past the ridge portions 1180*a* and 1180*b* (of the ridge structure 1172) and into the channel 1164. With the symmetrical raised portions 1176*a* and 1176*b* aligned with the recessed portions 1178*a* and 1178*b*, respectively, or aligned with the recessed portions 1178*b* and 1178*a*, respectively, the handle portion 1104 can be slid forward to engage with the housing portion 1102 in the selected cutter apparatus configuration. The ridge structure 1172 and the bearing 1162 are configured such that the ridge structure 1172 prevents the laterally extending end portions 1175*a* and 1175*b* (of the bearing 1162) from exiting the channel 1164 once the bearing 1162 is snap-fitted into or otherwise installed in the channel 1164. With the complementary portions of the exterior interface 1160 disengaged, the housing portion 1102 and the handle portion 1104 remain coupled together and are repositionable (in this example, both longitudinally and rotationally) in relation to each other.

Thus, in an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other. In example embodiments, the housing and the handle are repositionable further apart from each other (e.g., when portions of an engagement interface therebetween are disengaged) and a portion of the housing (e.g., a bearing or other coupling component or structure) is slidably coupled with a recessed or other complementary portion of the handle. In example embodiments, the housing and the handle are configured to permit rotation of the handle (about an axis) in relation to the housing, or vice versa, when the housing and the handle are not secured together. In example embodiments, the housing and the handle are one or more of directly coupled (e.g., in direct contact with each other), indirectly coupled (e.g., coupled together by one or more intermediary coupling elements or components), continuously coupled (e.g., at all times and/or by a continuous coupling structure or mechanism), and intermittently coupled (e.g., when elements or components providing or defining an engagement interface are repositionable in relation to each other).

Example embodiments of cutters (or cutter apparatuses) include a mechanism or device that facilitates improved rotational mobility as to the engagement interface. In this regard, as previously noted, the channel/guard structure 1108 differs from the preceding embodiment (described in relation to the cutter apparatus 100), for example, in that the locking tabs (of the channel/guard structure 108) are not included. Additionally, the interior interface 1170 differs from the preceding embodiment (described in relation to the cutter apparatus 100) in that the bearing 1162 includes or is provided with dual symmetrical flexible members 1174*a* and 1174*b* with laterally extending end portions 1175*a* and 1175*b* (e.g., engagement surfaces/ridges as shown), respectively. The flexible members 1174*a* and 1174*b* additionally include or are provided with laterally extending portions 1177*a* and 1177*b* (e.g., engagement surfaces/ridges as shown), respectively. Additionally, the interior interface 1170 differs from the preceding embodiment (described in relation to the cutter apparatus 100) in that the ridge structure 1172 includes or is provided as a cylindrical ridge structure (e.g., an inwardly extending annular ridge). The bearing 1162 additionally includes recesses 1179*a* and 1179*b* (e.g., circumferential recesses) which are configured to engage the ridge structure 1172 when the portions 1102 and 1104 are interfitted together. In this example embodiment, the recess 1179*a* is defined (at inner side walls thereof) by the laterally extending portions 1175*a* and 1177*a*, and the recess 1179*b* is defined (at inner side walls thereof) by the laterally extending portions 1175*b* and 1177*b*. In this example embodiment, the recesses 1179*a* and 1179*b* are configured to engage opposite (proximal and distal) sides of the ridge 1172 (e.g., a cylindrical ridge structure as shown), the engagement interface substantially limiting longitudinal movement of the housing portion 1102 relative to the handle portion 1104 while so engaged (thereby improving the rotational mobility provided by the interface).

Thus, in an example embodiment, a cutter apparatus includes a housing with a blade carrier configured for holding a blade, and a handle coupled to the housing via an engagement interface configured to allow a user of the cutter apparatus to selectively interfit together the housing and the handle in multiple different cutter apparatus configurations, wherein the engagement interface includes a coupler configured to permit the housing and the handle to be repositioned further apart (but not decoupled from each other) in a housing/handle reconfiguring mode in which the coupler permits the handle to be rotatably repositioned in relation to the housing or vice versa while substantially limiting longitudinal movement of the housing relative to the handle. In example embodiments, the engagement interface (e.g., configured to provide or facilitate a snap fit engagement) is configured to allow the housing and the handle to interfit in multiple different predetermined configurations. In example embodiments, the engagement interface includes an interior interface configured to couple (e.g., slidably and rotatably couple) the housing and the handle together. In example embodiments, the engagement interface includes an exterior interface configured to automatically lock the housing and the handle together when the housing and the handle are repositioned to interfit together in one of the cutter apparatus configurations. The exterior interface is configured, for example, to allow a user of the cutter apparatus to unlock the housing and the handle by actuating multiple release devices provided on one or more of the housing and the handle. In example embodiments, the engagement interface includes a channel and a bearing secured within and repositionable in relation to the channel. By way of example, the channel includes or is provided with an inwardly extending annular ridge and the bearing includes or is provided with a circumferential recess (e.g., including one or more engagement surfaces) configured to be repositionable in relation to the channel, the ridge and the bearing being configured such that the ridge prevents the bearing from exiting the channel. In such an implementation, the engagement interface includes a coupler which can be configured to provide or facilitate a snap fit engagement that permits the housing and the handle to be repositioned further apart (but not decoupled from each other) in a housing/handle reconfiguring mode in which the coupler permits the handle to be rotatably repositioned in relation to the housing or vice versa while substantially limiting longitudinal movement of the housing relative to the handle, that is, until a force sufficient to overcome the snap fit engagement forces the ridge out of the circumferential recess repositioning the housing and the handle closer together. The coupler can include a recess (circumferential or otherwise) configured to engage opposite (e.g., proximal and distal) sides of a ridge (cylindrical or otherwise) facilitating rotational mobility (of the handle in relation to the housing, or vice versa). In example embodiments, the coupler includes a spring-biased circumferential detent (or recess) configured to receive a complementary ridge structure therein (e.g., as the handle and housing transition are moved apart) providing a circumferential engagement of the housing and the handle in a housing/handle reconfiguring mode. In example embodiments, the blade carrier is configured for holding the blade in multiple different cutting edge orientations in relation to the housing, the cutting edge orientations including a pair of cutting edge orientations that are mirror images of each other. In example embodiments, the multiple different cutter apparatus configurations include a pair of configurations which, in conjunction with cutting edge orientations respectively selected from the pair of mirror image cutting edge orientations, accommodate ambidextrous operation of the cutter apparatus.

Thus, in an example embodiment, a cutter apparatus includes a housing with a blade carrier, and a handle coupled to and repositionable in relation to the housing to multiple different engagement positions at which the housing and the handle are secured together, the housing and the handle being configured such that when not secured together the housing and the handle remain coupled together and are repositionable in relation to each other to a housing/handle reconfiguring mode at which a circumferential engagement interface (e.g., between components of the housing and handle) facilitates rotational mobility of the handle in relation to the housing, or vice versa, while resisting a longitudinal repositioning of the housing toward to the handle. In example embodiments, the housing includes multiple guards. In implementations involving multiple guards, the handle can be coupled to and repositionable in relation to the housing to multiple different engagement positions at which the housing and the handle are secured together and a different guard is positioned for contact with a workpiece for each of the engagement positions.

Thus, in an example embodiment, a cutter apparatus includes a housing with a blade carrier configured for holding a blade, and a handle coupled to the housing via an engagement interface configured to allow a user of the cutter apparatus to selectively interfit together the housing and the handle in multiple different cutter apparatus configurations, wherein the engagement interface includes a coupler (e.g., a unitary or integrally formed bearing or other structure) configured to permit the housing and the handle to be repositioned further apart in a housing/handle reconfiguring mode in which the handle is rotatably repositionable in relation to the housing or vice versa (e.g., while substantially limiting longitudinal movement of the housing relative to the handle) and to engage a portion of the handle when the handle and housing are interfitted together in a locked configuration. In example embodiments, the engagement interface includes a channel and a bearing secured within and repositionable in relation to the channel.

The bearing can include a recess (e.g., a circumferential recess) that engages a portion of the handle (e.g., an inner portion or surface of the handle) when the handle and housing are in the housing/handle reconfiguring mode. In example embodiments, the recess is between and/or defined by distal and proximal ridges of the bearing. In example embodiments, the recess is defined at inner side walls thereof by ridges and/or other portions of the bearing.

The bearing can include a ridge (or other surface or portion) (e.g., defining a distal portion of the recess) that engages the handle (e.g., an inner portion or surface of the handle) when the handle and housing are interfitted together in the locked configuration. In example embodiments, the engagement interface is configured such that the ridge engages an inner portion or surface of the handle when the handle and housing are interfitted together in the locked configuration.

Figure 39:
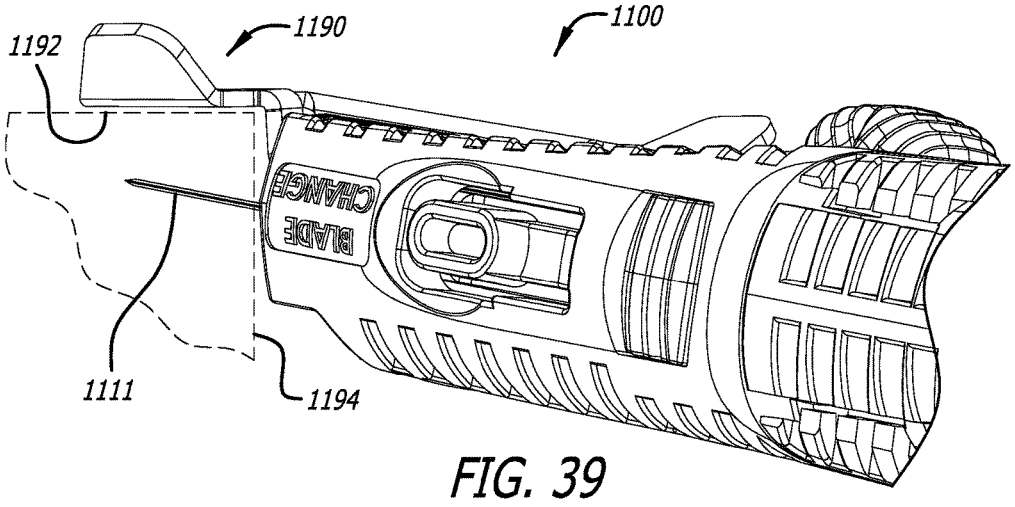
FIG. 39 is a partial perspective view of the cutter apparatus of FIG. 21 showing a blade extended from the cutter apparatus and a contact portion of a guard brought into contact with a workpiece during a cutting operation.

Example embodiments of cutters (or cutter apparatuses) include a guard (or guard structure) with multiple workpiece contact portions that are associated (e.g., mutually exclusively) with multiple different cutter configurations, respectively. Referring to FIG. 39, in this cutter apparatus configuration, the blade 1111 is extended from the cutter apparatus 1100, and a contact portion 1192 of a guard 1190 brought into contact with a workpiece 1194 during a cutting operation. The guard 1190 includes multiple contact portions, for example, symmetrical contact portions such as those provided by guards 1130*a* and 1130*b*.

Thus, in an example embodiment, a cutter apparatus includes a housing configured for gripping by a hand, a blade holder and/or blade coupled to the housing, a guard (or guide) secured (e.g., fixedly secured) to the housing, and a handle coupled to the housing via an engagement interface configured to allow a user of the cutter apparatus to selectively interfit together the housing and the handle in multiple different cutter apparatus configurations including a pair of configurations in which the guard, in relation to each configuration, faces the blade from right and left sides, respectively, of the cutter apparatus. In example embodiments, the guard includes multiple workpiece contact portions (mutually exclusively) associated with the multiple different cutter apparatus configurations, respectively. In example embodiments, the housing and the handle are tool-lessly reconfigurable.

In example embodiments, a cutter (or cutter apparatus) is reconfigurable (e.g., in relation to a gripping interface, surface, or structure) in multiple different cutter configurations and includes multiple cut guards (or cut guides) positioned for contact with a workpiece depending upon the cutter configuration. In example embodiments, at least one of the multiple cut guards is positioned for contact with a workpiece for each of the configurations. In example embodiments, a different cut guard is positioned for contact with a workpiece for each of the configurations.

One or more of the guards is configured, for example, such that the cutter can be slid along the top of a box, allowing the top of the box to be removed more easily and safely with less risk of damage to merchandise inside. A guard on either side of the knife, as described herein, facilitates ambidextrous operation.

Figure 22A:
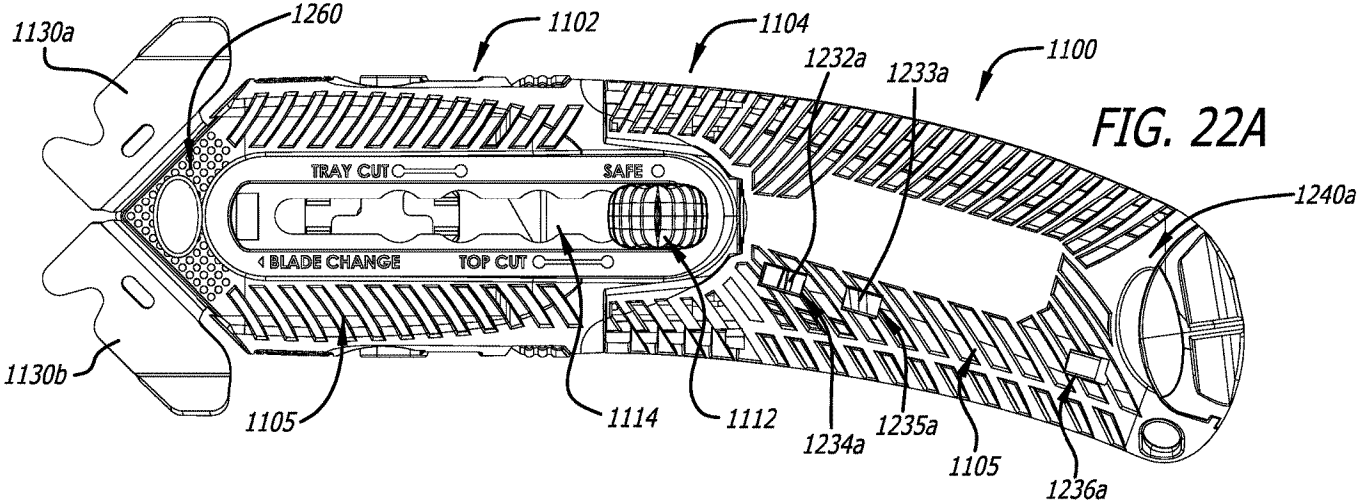
FIGS. 22A and 22B are left and right sides views, respectively, of the cutter apparatus of FIG. 21.
Figure 22B:
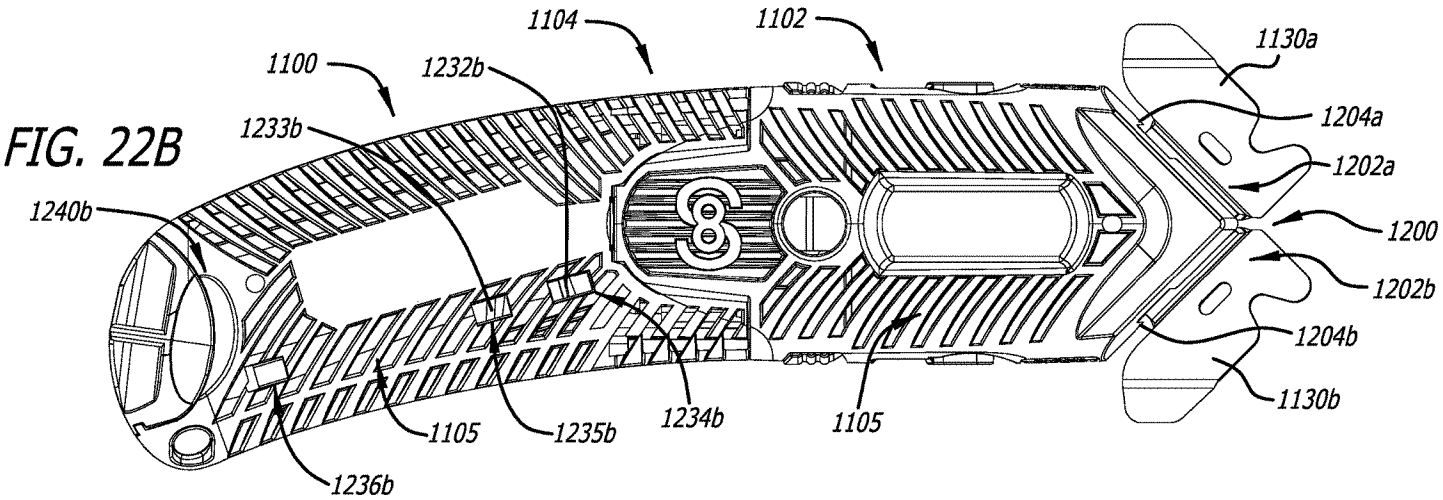

Referring to FIGS. 22A and 23, in this example embodiment, the housing portion (or distal portion) 1102 includes or is provided with an opening 1200 at least partially defined by surfaces (or other portions) of the housing (e.g., symmetrical surfaces) that face different directions, respectively. In this example embodiment, distal end portions 1202*a* and 1202*b* form or provide a V-shaped end portion of the housing (e.g. as shown). In this example embodiment, the cut guards 1130*a* and 1130*b* (mirror images of each other) are positioned adjacent to the distal end portions 1202*a* and 1202*b*, respectively.

Thus, in an example embodiment, a cutter apparatus includes a distal portion including a housing with an opening, a blade carrier coupled to and repositionable in relation to the housing, and multiple cut guards (or cut guides), and a proximal portion coupled to the distal portion such that the portions are repositionable in relation to and interfit with each other in multiple different configurations in which the portions are secured together and a different cut guard is positioned for contact with a workpiece for each of the configurations.

In example embodiments, the distal portion is or includes a guide for an actuator/slider configured for repositioning the blade carrier. The cutter apparatus can include, for example, an actuator (e.g., a slider) coupled to the housing and configured to allow a user of the cutter apparatus to reposition the blade carrier, and an actuator guide (e.g., a slider guide) secured to the housing. One or more of the cut guards and the actuator guide can be, but are not necessarily, integrally formed.

In example embodiments, the opening is defined at least in part by a two (symmetrical) end portions (e.g., substantially flat/planar surfaces) of the housing that face the opposing guards, respectively.

In example embodiments, the cut guards are fixedly positioned (e.g., secured together) in relation to each other (and in relation to the housing). The multiple cut guards include, for example, two cut guards positioned at opposite sides (or portions) of the housing. In this example embodiment, the cut guards 1130*a* and 1130*b* are positioned adjacent to opposite ends 1204*a* and 1204*b*, respectively, of the opening 1200.

The proximal portion includes, for example, a handle with a bottom side (e.g., with a curved ergonomic shape configured to be held by the inside of the user's fingers opposite the knuckles during a cutting operation) and, for each of the configurations, one of the cut guards is positioned adjacent to a side (or portion) of the housing that is contiguous and/or in alignment with the bottom side of the handle and the other guard is positioned adjacent to a top side of the cutter apparatus.

Figure 40:
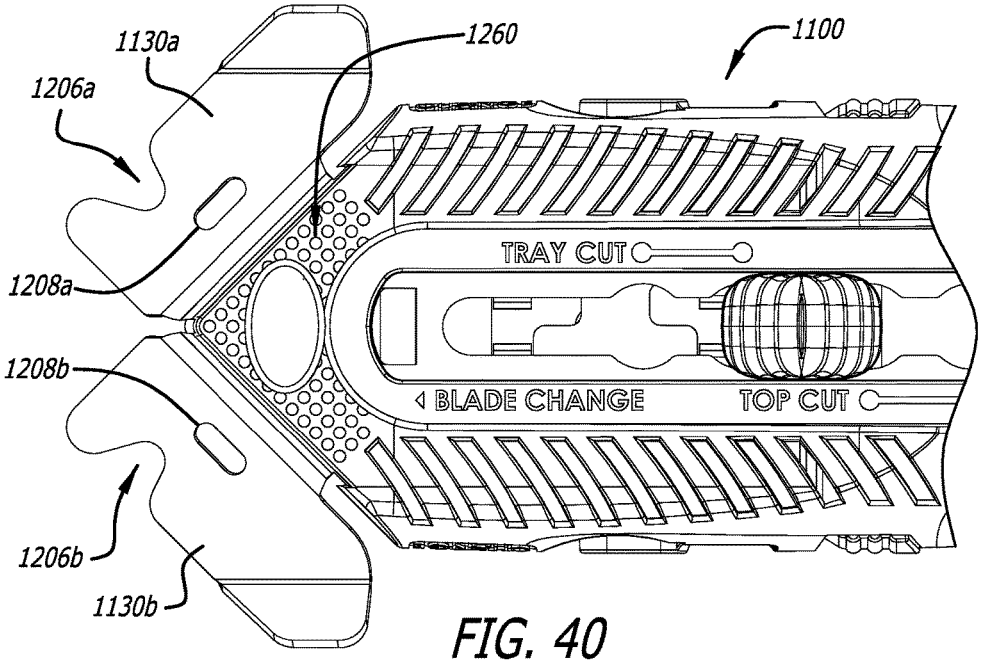
FIG. 40 is a partial side view of the cutter apparatus of FIG. 21 showing opposing cut guards of the guard structure and their respective recessed portions.

One or more of the cut guards (e.g., all of the cut guards) can include a recessed portion (i.e., a tape splitter) that faces the workpiece when the cut guard is in a configuration in which it is positioned for contact with the workpiece. A tape splitter formed into each guard allows taped boxes to be opened without exposing the blade, reducing the risk of accidental cuts. Referring to FIG. 40, in this example embodiment, the cut guards 1130*a* and 1130*b* can include or be provided with recessed portions 1206*a* and 1206*b* (e.g., contoured as shown), respectively. Additionally, in this example embodiment, the cut guards 1130*a* and 1130*b* can include or be provided with "race track" openings 1208*a* and 1208*b* (e.g., generally longitudinal in relation to a direction along which the guard is repositioned over a workpiece), respectively.

Thus, in an example embodiment, a cutter apparatus includes a housing configured for gripping by a hand, a blade holder and/or blade coupled to the housing, and one or more guards coupled to the housing, at least one of said guards having an opening and being configured such that the opening faces a workpiece when said guard is brought into contact with and repositioned over the workpiece (said opening reducing friction). In example embodiments, the one or more guards include multiple guards. In example implementations, the guards include openings that are generally longitudinal in relation to a direction along which the guards are repositioned over a workpiece respectively while in use. In example implementations involving multiple guards, at least two of the guards are fixed in position in relation to each other. A distal portion of the housing can include or be provided with a tactile surface adjacent to the guards.

In example embodiments, a cutter apparatus includes a housing, a blade holder coupled to the housing, and multiple guards coupled to the housing, at least two of the guards being fixed in position in relation to each other and/or in relation to a distal portion of the housing, the housing including distal and proximal portions that are repositionable in relation to each other in multiple different configurations in which the portions are secured together and a different guard is positioned for contact with a workpiece for each of the configurations. In example embodiments, for each of the configurations, one of the guards is positioned adjacent to a side of the housing that is adjacent to a bottom side of the cutter apparatus. In example embodiments, at least one of the guards includes a recessed portion that faces the workpiece when the guard is in a configuration in which the guard is positioned for contact with the workpiece.

Figures 35, 36A, 36B:
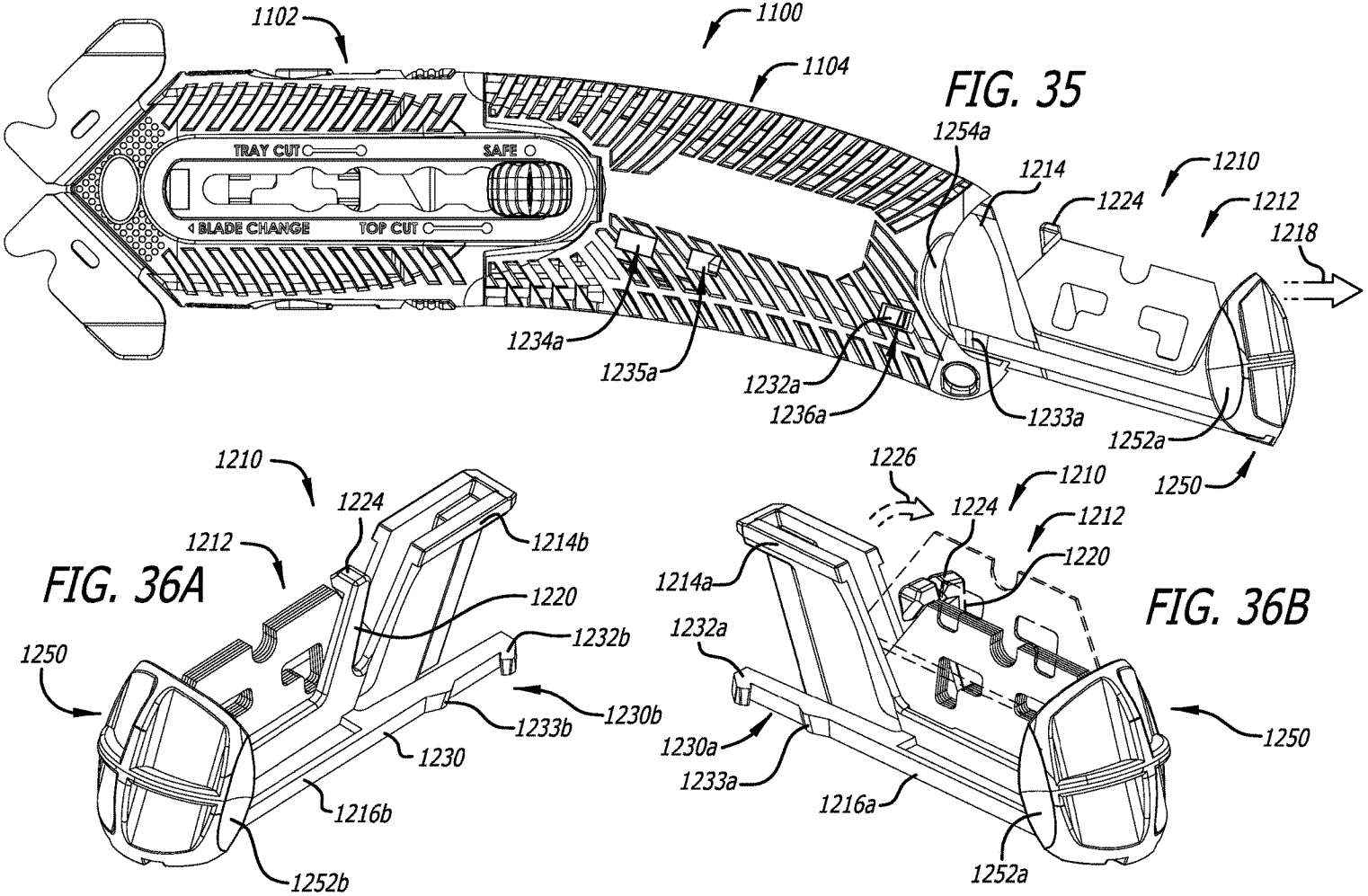
FIG. 35 is a side view of the cutter apparatus of FIG. 21 showing the blade storage assembly repositioned in relation to the handle portion for gaining access to the spare blade holder of the assembly.
FIG. 36A is a perspective view of the blade storage assembly of the cutter apparatus of FIG. 21.
FIG. 36B is another perspective view of the blade storage assembly in which its blade retention spring is shown repositioned in relation to the blade storage compartment for allowing a user of the cutter apparatus to withdraw a blade from the blade storage compartment.

Example embodiments of cutters (or cutter apparatuses) include a mechanism or device that facilitates rotatable repositioning of a blade storage assembly about an axis that is parallel or substantially parallel to a longitudinal axis associated with a blade holder and/or a blade of the cutter. Referring to FIGS. 35, 36A, 36B, 37A, 37B, 38A, and 38B, in this example embodiment, the cutter apparatus 1100 includes a blade storage assembly 1210 that is repositioned in relation to the handle portion 1104 for gaining access to a spare blade holder 1212 (of the assembly 1210). In this example embodiment, the blade storage assembly 1210 is coupled (e.g., slidably coupled) to the handle portion 1104. The blade storage assembly 1210 includes or is provided with upper rails 1214*a* and 1214*b* and lower rails 1216*a* and 1216*b* that interface with complementary portions or structures of the handle portion 1104, allowing the blade storage assembly 1210 to be slidably withdrawn from the base of the handle as denoted by arrow 1218 (FIG. 35). By way of example, the blade storage assembly 1210 is coupled to the handle portion 104 with a friction fit (e.g., of sufficient strength to steady the assembly in position and/or resist slight forces imparted, perhaps inadvertently, by a user of the cutter apparatus).

Thus, in an example embodiment, a cutter apparatus includes a housing configured for gripping by a hand, a blade holder and/or a blade coupled to the housing, and a blade storage assembly that is coupled to the housing and rotatably repositionable about an axis parallel or substantially parallel to a longitudinal axis associated with the blade holder and/or the blade. The blade holder and/or the blade can be, for example, slidably supported within the housing and repositionable along the longitudinal axis.

Example embodiments of cutters (or cutter apparatuses) include a blade storage compartment coupled to and repositionable in relation to a portion of the cutter (e.g., a handle portion) and a mechanism or device that facilitates securing blades within the blade storage compartment and preventing the blade storage assembly from being decoupled (or separated) from the portion of the cutter. The blade storage assembly 1210 and the handle portion 1104 include surfaces (e.g., spring-biased latch elements and complementary engagement surfaces, respectively) that prevent the blade storage assembly from being completely separated from the handle portion.

The blade storage holder (or compartment) 1212 is configured for holding spare blades (e.g., five blades) and includes a plurality of springs (or other biasing components) configured, for example, to perform one or more of: securing blades within the blade storage compartment, controlling how many blades can be simultaneously withdrawn from the blade storage compartment, providing resistance to extending the blade storage assembly from the housing (e.g., during an initial/partial segment of the repositioning movement), and preventing the blade storage assembly from being completely removed from the housing (e.g., via positive lock with the housing). Referring to FIGS. 36A and 36B, in this example embodiment, the plurality of springs includes a spring 1220 (e.g., a plastic spring molded in the blade storage compartment) configured to secure blades within the blade storage compartment (e.g., prevent the blades from falling out) and control how many blades can be simultaneously withdrawn from the blade storage compartment (e.g., only allow withdrawal of one blade at a time). The spring 1220 includes a blade retention portion 1224 (e.g., with surfaces/portions shaped and configured as shown). In FIG. 36B, the spring 1220 is shown (in dashed lines) repositioned in relation to the blade storage compartment 1212 as denoted by arrow 1226 for allowing a user of the cutter apparatus to withdraw a blade from the blade storage compartment. In this example embodiment, the plurality of springs includes springs 1230*a* and 1230*b* (e.g., plastic springs at the base of and located at opposites sides respectively of the spare blade compartment) configured to provide resistance to extending the blade storage assembly from the housing (e.g., latches into the rear body to provide resistance for extending the spare blade compartment) and prevent the blade storage assembly from being completely removed from the housing (when the assembly is extended to gain access to the blade storage compartment).

Thus, in an example embodiment, a cutter apparatus includes a housing configured for gripping by a hand, a blade holder and/or a blade coupled to the housing, and a blade storage assembly coupled to and repositionable in relation to a portion of the housing, the blade storage assembly including a blade storage compartment configured for holding spare blades and a plurality of springs configured to secure blades within the blade storage compartment and prevent the blade storage assembly from being completely removed from the housing.

Example embodiments of cutters (or cutter apparatuses) include a blade storage assembly (or blade storage compartment or blade shuttle) that is repositionable in relation to a handle (rear body) of the cutter, and a mechanism for securing/locking the blade storage assembly in multiple different positions in relation to the handle via engagement with side wall openings of the cutter. For example, a handle portion of the cutter includes or is provided with one or more side walls having openings, and a blade shuttle includes one or more springs or biased elements configured (e.g., with a pair of springs including hooks facing opposing side walls within the handle portion) to facilitate side wall engagement of blade shuttle.

Referring to FIGS. 35, 36A, 36B, 37A, 37B, 38A, and 38B, the handle portion 1104 differs from the preceding embodiment (described in relation to the cutter apparatus 100) in that it includes side wall openings 1234*a*, 1235*a*, and 1236*a* and opposing side wall openings 1234*b*, 1235*b*, and 1236*b* on its left and right sides, respectively. Additionally, the blade storage assembly 1210 utilizes an engagement mechanism that includes springs in the form of hooks 1232*a* and 1232*b* configured to operate in conjunction with adjacent protrusions 1233*a* and 1233*b*, respectively, for securing/locking the blade storage assembly (blade shuttle) in multiple different positions in relation to the handle portion (rear body) via engagement with the side wall openings. For example, the multiple different positions can include a closed position (e.g., fully closed and/or locked) and an opened position (e.g., a position suitable for facilitating a blade change operation). The multiple different positions can include an intermediary position such as, for example, a partially opened position that allows a user of the cutter to determine (visually or by touch, for example, if lighting is inadequate) whether any spare blades remain in the shuttle.

Figure 37A:
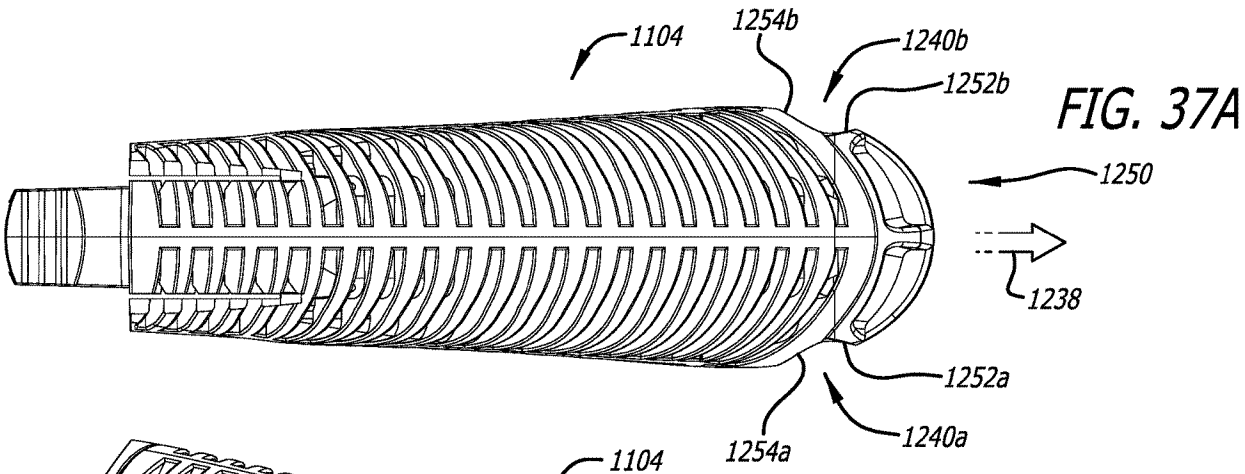
FIG. 37A is a top view of the handle portion of the cutter apparatus of FIG. 21 in which the blade storage assembly is shown in its fully retracted secured closed position.
Figure 37B:
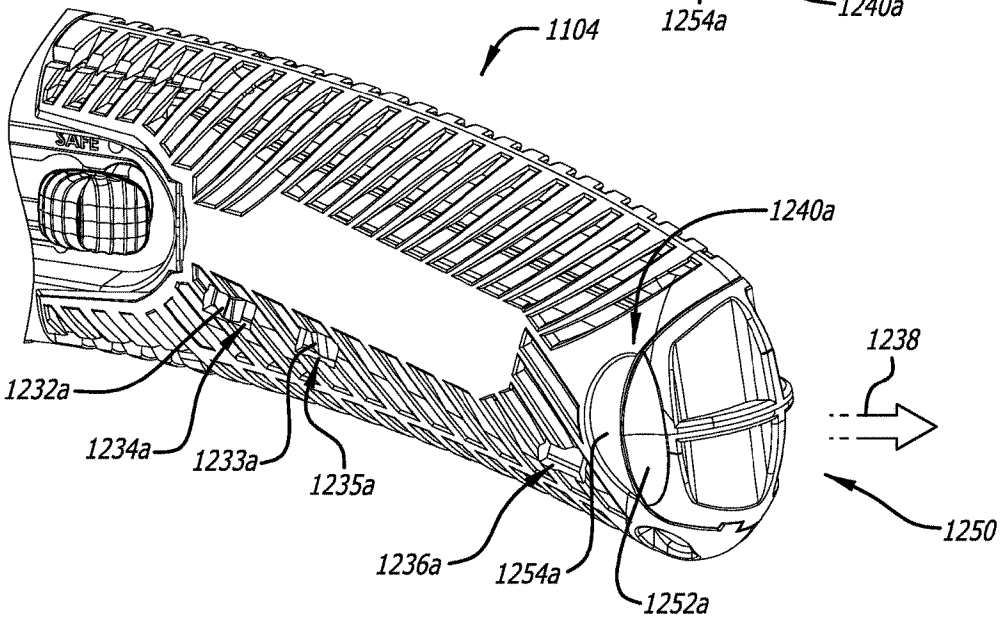
FIG. 37B is a left side view of the handle portion of FIG. 37A.
Figure 38A:
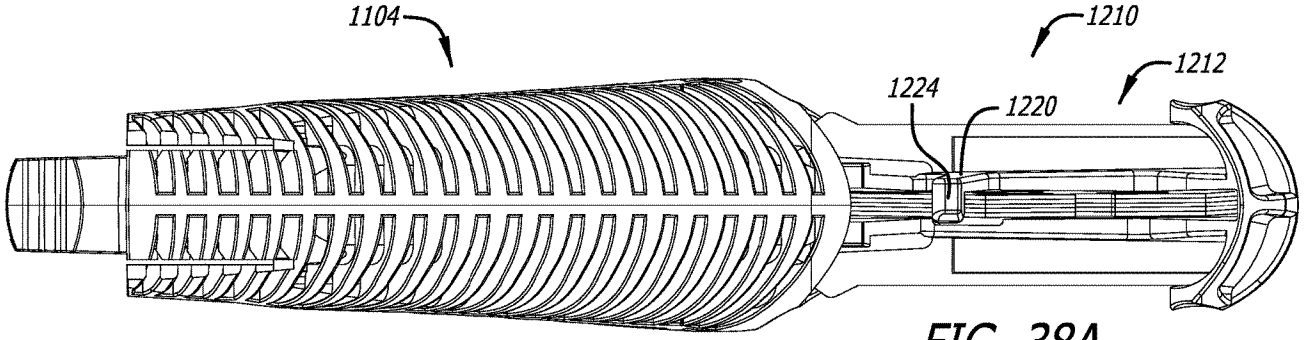
FIG. 38A is a top view of the handle portion of the cutter apparatus of FIG. 21 in which the blade storage assembly is shown in its fully extended secured open position.
Figure 38B:
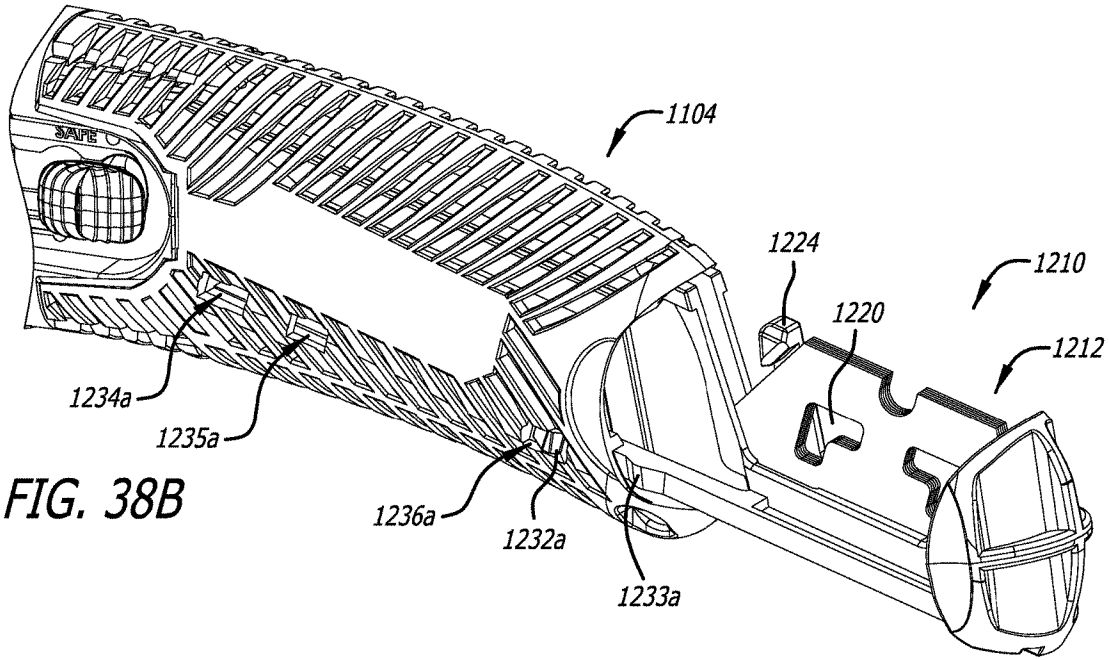
FIG. 38B is a left side view of the handle portion of FIG. 38A.

Referring to FIGS. 37A and 37B, when the blade storage assembly 1210 is in its fully retracted closed position, the hook 1232*a* and the protrusion 1233*a* detent into the side wall openings 1234*a* and 1235*a*, respectively, securing the assembly in position until (employing sufficient force to overcome the detent resistance) a user of the cutter apparatus 1100 withdraws the assembly as denoted by arrow 1238. Referring to FIGS. 38A and 38B, when the blade storage assembly 1210 is repositioned to its fully extended opened position, the hook 1232*a* detents into the side wall opening 1236*a* and the protrusion 1233*a* repositions external to (detents proximal to) the base of the handle portion 1104 securing the assembly for withdrawing a blade from and/or reloading the blade storage compartment 1212. At the opposite side of the handle portion 1104, although not shown, when the blade storage assembly 1210 is in its fully retracted closed position, the hook 1232*a* and the protrusion 1233*a* detent into the side wall openings 1234*b* and 1235*b*, respectively. Likewise (not shown), when the blade storage assembly 1210 is repositioned to its fully extended opened position, the hook 1232*b* detents into the side wall opening 1236*b* and the protrusion 1233*b* repositions external to (detents proximal to) the base of the handle portion 1104. Additionally, in example implementations, the cutter is configured such that one or more springs or biased elements engage (e.g., detent into) one or more side wall (or other) openings securing/locking the blade storage assembly (blade shuttle) in a position between a locked/fully closed position and a fully opened/blade change position. By way of example, resistance to repositioning the blade shuttle (frictional contact with the protrusions 1233*a* and 1233*b*) can be considered to further include securing/locking the blade shuttle in an intermediary position such as previously described via engagement (detent) of the hooks 1232*a* and 1232*b* with the openings 1235*a* and 1235*b*, respectively.

Thus, in an example embodiment, a cutter apparatus includes a housing configured for gripping by a hand, a blade holder and/or a blade coupled to the housing, and a blade storage assembly (blade storage shuttle) coupled to and repositionable in relation to a portion of the housing, the blade storage assembly including a blade storage compartment and engagement members (e.g., one or more pairs of engagement members), the housing including side wall portions, the side wall portions and the engagement members being configured to secure the blade storage assembly in one or more positions (in relation to the housing). In example embodiments, the engagement members are configured to provide resistance to extending the blade storage assembly from the housing and to prevent the blade storage assembly from being completely removed from the housing. In example embodiments, the engagement members (e.g., pairs of engagement members) are located at side portions of the blade storage assembly. The engagement members include, for example, at least one pair of engagement members (e.g., located at a side portion of the blade storage assembly). In example implementations, the engagement members include a protrusion (e.g., laterally extending from the blade storage assembly) and a hook (e.g., spring-biased and distally located in relation to the protrusion).

The housing (e.g., a handle or handle portion) can include or be provided with recessed portions (e.g., side wall openings or other engagement surfaces or portions) configured to receive the engagement members. The housing (e.g., a handle or handle portion) can include or be provided with inside surfaces or portions configured to receive the engagement members.

In example implementations, the housing includes surfaces or portions configured to receive (all of) the engagement members when the blade storage assembly is in a closed position (and a subset of the engagement members when the blade storage assembly is in the opened position). In example implementations, the housing and blade storage assembly are configured such that at least one engagement member (e.g., the protrusions on opposite sides of the shuttle) is positioned within the housing and external to the housing when the blade storage assembly is in a closed position and an opened position, respectively. In example implementations, the housing and blade storage assembly are configured such that at least one engagement member (e.g., a pair of hooks located on opposite sides of the shuttle respectively) is positioned within (and engaged with a portion of) the housing when the blade storage assembly is in either a closed position or an opened position.

The blade storage assembly can include a (first) spring molded to an interior portion of the blade storage compartment, the (first) spring being configured to secure blades within the blade storage compartment and control how many blades can be simultaneously withdrawn from the blade storage compartment. In example embodiments, the blade storage assembly includes concave (scoop) portions shaped to be grasped by a user of the cutter apparatus for repositioning (pulling or pushing) the blade storage assembly in relation to the housing. In example embodiments, the blade storage assembly includes a pair of opposing recesses (e.g., at a base portion thereof) configured to be engaged by a user of the cutter apparatus for repositioning the blade storage assembly in relation to the housing.

Example embodiments of cutters (or cutter apparatuses) include a housing (e.g., handle) and a blade storage assembly (or blade shuttle) configured for repositioning in relation to a housing, the cutter including at a base portion thereof opposing recesses configured to be engaged by a user for repositioning (pulling or pushing) the blade storage assembly in relation to the housing.

Referring to FIGS. 35, 36A, 36B, 37A and 37B, in this example embodiment, the cutter apparatus 1100 includes (at a base portion thereof) engagement portions 1240*a* and 1240*b* in the form of recesses (e.g., scoop-shaped surfaces) configured to be grasped by a user for repositioning (pulling or pushing) the blade storage assembly 1210 in relation to the housing. In this example implementation, the blade storage assembly 1210 includes or is provided with peripheral portions 1252*a* and 1252*b* which define (in part) the engagement portions 1240*a* and 1240*b*, respectively. In this example implementation, the handle 1104 (at opposing sides of its base) includes or is provided with recesses 1254*a* and 1254*b* that interface (flush, in this example) with the peripheral portions 1252*a* and 1252*b*, respectively.

Thus, in an example embodiment, a cutter apparatus includes a handle, a blade holder and/or a blade coupled to the handle, and a blade storage assembly (or blade storage shuttle) coupled to and repositionable in relation to a portion of the handle, wherein one or more of the handle and the blade storage assembly define (opposing) recesses (e.g., at a base portion of the handle) configured to be engaged by a user of the cutter apparatus for repositioning (pulling or pushing) the blade storage assembly in relation to the housing. In example embodiments, the recesses are defined by portions of the housing and the blade storage assembly that locate adjacently (interfacing) to provide generally concave or scoop-shaped gripping surfaces at opposing sides of the handle (e.g., when the blade storage assembly is in a closed position). In example embodiments, the blade storage assembly includes a blade storage compartment with a shuttle base, and the recesses are defined at least in part by peripheral portions of the shuttle base. In example embodiments, the recesses are defined at least in part by base portions of the handle (e.g., which together with peripheral portions of the shuttle base form an opposing pair of gripping recesses/scoops). Recesses at the base portion of the handle can be configured to define or provide an interface, for example, with complementary peripheral edges of the shuttle base.

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A cutter apparatus comprising:

a housing with a blade carrier configured for holding a blade; and a handle coupled to the housing via an engagement interface configured to allow a user of the cutter apparatus to selectively interfit together the housing and the handle in multiple different cutter apparatus configurations;

wherein the engagement interface includes a coupler configured to permit the housing and the handle to be repositioned further apart in a housing/handle reconfiguring mode in which the handle is rotatably repositionable in relation to the housing or vice versa and to engage a portion of the handle when the handle and the housing are interfitted together in a locked configuration;

wherein the coupler includes a channel and a spring-biased circumferential detent configured to receive a complementary ridge structure of the channel therein providing a circumferential engagement of the housing and the handle in the housing/handle reconfiguring mode.

2. The cutter apparatus of claim 1, wherein the engagement interface includes an interior interface configured to couple the housing and the handle together.

3. The cutter apparatus of claim 2, wherein the interior interface is configured to slidably and rotatably couple the housing and the handle.

4. The cutter apparatus of claim 1, wherein the engagement interface includes a bearing, and the channel includes or is provided with an inwardly extending annular ridge and the bearing includes or is provided with one or more engagement surfaces configured to be repositionable in relation to the channel, the ridge and the bearing being configured such that the ridge prevents the bearing from exiting the channel.

5. The cutter apparatus of claim 1, wherein the engagement interface includes a bearing secured within and repositionable in relation to the channel, the bearing including a recess that engages a portion of the handle when the handle and the housing are in the housing/handle reconfiguring mode.

6. The cutter apparatus of claim 5, wherein the recess is circumferential.

7. The cutter apparatus of claim 5, wherein the bearing includes a ridge that engages the handle when the handle and the housing are interfitted together in the locked configuration.

8. The cutter apparatus of claim 7, wherein the engagement interface is configured such that the ridge engages an inner portion or surface of the handle when the handle and the housing are interfitted together in the locked configuration.

9. A cutter apparatus comprising:

a housing with a blade carrier configured for holding a blade; and a handle coupled to the housing via an engagement interface configured to allow a user of the cutter apparatus to selectively interfit together the housing and the handle in multiple different cutter apparatus configurations;

wherein the engagement interface includes a channel and a bearing configured to permit the housing and the handle to be repositioned further apart in a housing/handle reconfiguring mode in which the handle is rotatably repositionable in relation to the housing or vice versa;

wherein the channel includes or is provided with an inwardly extending annular ridge and the bearing includes or is provided with one or more engagement surfaces configured to be repositionable in relation to the channel, the ridge and the bearing being configured such that the ridge prevents the bearing from exiting the channel.

10. The cutter apparatus of claim 9, wherein the engagement interface is configured to allow the housing and the handle to interfit in multiple different predetermined configurations.

11. The cutter apparatus of claim 9, wherein the engagement interface includes an exterior interface configured to automatically lock the housing and the handle together when the housing and the handle are repositioned to interfit together in one of the cutter apparatus configurations.

12. The cutter apparatus of claim 11, wherein the exterior interface is configured to allow a user of the cutter apparatus to unlock the housing and the handle by actuating multiple release devices provided on one or more of the housing and the handle.

13. The cutter apparatus of claim 9, wherein the bearing is secured within and repositionable in relation to the channel.

14. The cutter apparatus of claim 9, wherein the bearing includes a recess that is configured to engage opposite sides of the ridge facilitating rotational mobility of the handle in relation to the housing, or vice versa.

15. The cutter apparatus of claim 9, wherein the engagement interface includes a spring-biased circumferential detent configured to receive a complementary ridge structure of the channel therein providing a circumferential engagement of the housing and the handle in the housing/handle reconfiguring mode.

16. The cutter apparatus of claim 9, wherein the blade carrier is configured for holding the blade in multiple different cutting edge orientations in relation to the housing, the cutting edge orientations including a pair of cutting edge orientations that are mirror images of each other.

17. The cutter apparatus of claim 16, wherein the multiple different cutter apparatus configurations include a pair of configurations which, in conjunction with cutting edge orientations respectively selected from the pair of mirror image cutting edge orientations, accommodate ambidextrous operation of the cutter apparatus.

18. The cutter apparatus of claim 9, wherein the housing includes multiple guards.

19. The cutter apparatus of claim 18, wherein the handle is coupled to and repositionable in relation to the housing to multiple different engagement positions at which the housing and the handle are secured together and a different guard is positioned for contact with a workpiece for each of the engagement positions.

20. A cutter apparatus comprising:

a housing with a blade carrier configured for holding a blade; and a handle coupled to and repositionable in relation to the housing to multiple different engagement positions at which the housing and the handle are secured together, the housing and the handle being configured such that when not secured together the housing and the handle remain coupled together and are repositionable in relation to each other to a housing/handle reconfiguring mode at which a circumferential engagement interface facilitates rotational mobility of the handle in relation to the housing about a rotational axis, or vice versa, while resisting a longitudinal repositioning of the housing toward to the handle, wherein the rotational axis extends longitudinally in a length direction of the cutter apparatus.

* * * * *